US008413851B2

(12) United States Patent
Bruinius

(10) Patent No.: US 8,413,851 B2
(45) Date of Patent: Apr. 9, 2013

(54) SECURITY DEVICE FOR STORAGE TANKS

(75) Inventor: Mark W. Bruinius, Ada, MI (US)

(73) Assignee: Burlingame Industries, Inc., Grand Rapids, MI (US)

( * ) Notice: Subject to any disclaimer, the term of this patent is extended or adjusted under 35 U.S.C. 154(b) by 283 days.

(21) Appl. No.: 12/983,524

(22) Filed: Jan. 3, 2011

(65) Prior Publication Data

US 2011/0168724 A1 Jul. 14, 2011

Related U.S. Application Data

(60) Provisional application No. 61/293,415, filed on Jan. 8, 2010.

(51) Int. Cl.
*E05B 65/52* (2006.01)

(52) U.S. Cl.
USPC ..... 222/153.14; 222/74; 222/153.02; 222/153.03; 222/182; 220/565; 220/567.2; 220/725; 70/158; 70/159; 70/174; 137/382; 137/383

(58) Field of Classification Search ..... 222/74, 222/75, 153.01–153.03, 153.13, 153.14, 222/182; 220/565, 567, 567.2, 724, 725, 220/728, DIG. 24; 137/377, 382, 383; 70/158, 70/159, 162, 164, 174–180, 232; 312/216–220
See application file for complete search history.

(56) References Cited

U.S. PATENT DOCUMENTS 1,512,638 A * 10/1924 Robinson ..... 222/130
1,632,111 A * 6/1927 Bevilacqua ..... 126/42
1,762,582 A * 6/1930 Nunes ..... 70/180
1,854,352 A * 4/1932 Thomas ..... 222/3
2,004,966 A * 6/1935 Whitlock et al. ..... 221/96
2,067,994 A 1/1937 Thwaits
2,561,595 A * 7/1951 Putnam ..... 211/75
(Continued)

FOREIGN PATENT DOCUMENTS

JP 2000128275 A 5/2000
WO 9967170 A1 12/1999

OTHER PUBLICATIONS

International Search Report and Written Opinion from corresponding Patent Cooperation Treaty Application No. PCT/US2011/020039, dated Sep. 5, 2011, which corresponds to U.S. Appl. No. 12/983,524.
"Archive.org snapshot of website at http://fuelproofco.uk/fuelstores/index.htm dated Dec. 16, 2008".

*Primary Examiner* — J. Casimer Jacyna
(74) *Attorney, Agent, or Firm* — Gardner, Linn, Burkhart & Flory, LLP

(57) ABSTRACT

A security device protects the vulnerable portions or accessories of a bulk storage tank or container against unauthorized access. The device includes a housing that covers the vulnerable portions of the tank, the housing having two or more lockable doors that selectively permit access to the tank or container via two or more respective apertures. A first door is openable after unlocking a readily-accessible lock, while the second movable door is openable after an elongate lock member that is positioned internally within the housing is moved to an unlocking position. The elongate lock member can be moved to its unlocking position after the first door is opened. Certain tank operations, such as dispensing fuel, may be carried out after unlocking and opening a single door, while other operations, such as refilling the tank, may be accomplished after opening a second door once the first door has been opened.

22 Claims, 18 Drawing Sheets

U.S. PATENT DOCUMENTS

| | | | | | |
|---|---|---|---|---|---|
| 3,963,144 | A | | 6/1976 | Berwald | |
| 4,030,628 | A | | 6/1977 | Hippert, Jr. | |
| 4,301,828 | A | | 11/1981 | Martin, Jr. | |
| 4,335,909 | A | | 6/1982 | Schmitz, Jr. | |
| 4,352,370 | A | * | 10/1982 | Childress | 137/382 |
| 4,959,980 | A | | 10/1990 | Phillips | |
| 5,199,286 | A | | 4/1993 | Jakubas | |
| 5,638,858 | A | | 6/1997 | Gettinger et al. | |
| 6,606,888 | B2 | * | 8/2003 | Steinle et al. | 70/178 |
| 7,140,211 | B2 | | 11/2006 | Tremblay | |
| 7,478,646 | B2 | | 1/2009 | Borrenpohl et al. | |
| 2008/0128453 | A1 | | 6/2008 | Burckholter | |
| 2009/0045216 | A1 | | 2/2009 | Mamaghani | |
| 2010/0206895 | A1 | * | 8/2010 | Ratermann | 220/728 |

* cited by examiner

SECURITY DEVICE FOR STORAGE TANKS

CROSS REFERENCE TO RELATED APPLICATION

The present application claims the benefit of U.S. provisional application Ser. No. 61/293,415, filed Jan. 8, 2010, which is hereby incorporated herein by reference in its entirety.

FIELD OF THE INVENTION

The present invention relates generally to security devices, and in particular, to devices used to secure storage tanks, and especially bulk storage tanks such as above-ground fuel storage tanks.

BACKGROUND OF THE INVENTION

Bulk storage tanks, such as above-ground fuel tanks or dry bulk storage tanks, typically include one or more access ports that permit filling the tank with bulk material (such as liquid fuel or dry bulk goods), and that permit removing or dispensing bulk materials from the tank. Typically, such tanks are not highly secured against unauthorized access or tampering, which makes them vulnerable to such access and theft. This can be particularly problematic when the bulk materials contained in the tanks are highly valuable, such as liquid fuels.

SUMMARY OF THE INVENTION

The security device of the present invention may be adapted for use on substantially any bulk storage container or tank, and may be particularly well suited to above-ground bulk fuel tanks, such as may be used by a business that operates a fleet of motor vehicles. The device covers and protects the most vulnerable portions of the tank from theft, unauthorized access, or vandalism. The security device includes a lockable housing for attachment along a top surface of a bulk storage tank, the housing having at least two apertures for permitting access to a cavity defined by the housing, with each of the apertures selectively covered by a respective movable door. At least one of the door-covered apertures may be arranged on the housing in a manner that permits an operator to readily access the door and aperture while standing on the ground or other support surface that also supports the bulk storage tank. Once the door is open, an elongate lock member may be actuated to unlatch the other door to permit access to the other aperture in the housing, such as for accessing a fill port on the tank. The security device is capable of protecting substantially all of the vulnerable portions of a bulk storage tank while still permitting limited access to those portions, and while using a single lock to secure only the ground-accessible door.

According to one form of the present invention, a security device for bulk storage tanks includes a housing defining a cavity, with first and second apertures in the housing for permitting access to the cavity. First and second movable access doors are positioned at respective ones of the housing apertures, and an elongate lock member is disposed in the cavity of the housing. The lock member is actuatable or movable to selectively lock or secure the second movable access door only when the first movable access door is open. The elongate lock member has a proximal end portion that is disposed toward the first movable access door, and has a distal end portion that is disposed toward the second movable access door. The elongate lock member is substantially fixed in a locking position when the first movable access door is in a closed position. A latch receiver at the second movable access door receives the distal end portion of the elongate lock member when the lock member is in its locking position, thereby preventing the second movable access door from being opened when the latch receiver is engaged by the lock member. The distal end portion of the elongate lock member is configured to disengage the latch receiver of the second movable access door when the elongate lock member is in the unlocking position, which permits the second movable access door to be moved to an open position, thereby permitting access to the cavity via the second aperture.

In one aspect, the first movable access door is pivotably coupled near one end of the housing, and the second movable access door is pivotably coupled near an opposite end of the housing.

In another aspect, the first movable access door is oriented generally vertically when it is closed, and the second movable access door is oriented generally horizontally when it is closed.

In yet another aspect, a portion of the cavity is accessible between the first movable access door in its closed position and a bulk storage tank when the security device is positioned at the bulk storage tank.

In still another aspect, an attachment device is disposed inside the cavity and coupled to an inner surface of the housing, the attachment device being configured to couple the housing to the bulk storage tank. Optionally, the attachment device is configured to releasably couple the housing to the bulk storage tank, and may further include a hook portion for engaging the bulk storage tank at a support ring or loop, which may be disposed along an outer surface of the bulk storage tank. For example, the attachment device may be a turnbuckle that permits adjustment of the length of the attachment device.

Optionally, the attachment device includes a generally U-shaped bracket and a housing cross member. The U-shaped bracket extends around a pipe extending from the bulk storage tank, and has opposite end portions that engage and are retained at the housing cross member.

In a further aspect, the attachment device is accessible only through one of the first and second apertures in the housing when the housing is positioned at a bulk storage tank, and when one of the first and second movable access doors is in its open position.

In a still further aspect, the security device includes a lock that is operable to secure the first movable access door in its closed position.

In another aspect, the first movable access door includes a lock aperture for receiving a lock tab that is coupled to the housing, and which is configured to extend at least partially through the lock aperture only when the first movable access door is at or near its closed position. The lock is releasably attachable to the lock tab to selectively secure the first movable access door in its closed position.

In yet another aspect, the housing of the security device includes a pair of spaced side panels, a top panel coupled between the side panels along upper edges of the side panels, and a rear panel opposite the first aperture and coupled between the side panels and the top panels along rear edges of those panels. Optionally, the second movable access door is pivotably coupled to the top panel near the rear panel of the housing. The top panel may include a vent aperture for engaging a vent conduit that is coupled to the bulk storage tank when the housing is positioned at the tank.

According to a still further aspect, the elongate lock member is slidably supported along the top panel of the housing by at least two spaced support members. Optionally, the elongate lock member may be movably or slidably supported along one or more side panels of the housing by other support members, such by passing through apertures in flanges of the side panels.

According to another form of the present invention, a secure storage tank system includes a bulk storage tank having at least one side wall, a housing positioned at the side wall of the storage tank, and the housing defining a cavity and first and second apertures for permitting access to the cavity. First and second movable access doors are positioned at respective ones of the first and second apertures of the housing, the movable access doors selectively covering the first and second apertures. An elongate lock member is movably coupled to the housing in the cavity, and has a proximal end portion disposed toward the first movable access door and a distal end portion disposed toward the second movable access door. When the first movable access door is in an open position, the elongate lock member is movable to an unlocking position, and when the first movable access door is closed, the elongate lock member is substantially fixed in a locking position. The second movable access door includes a latch receiver that receives the distal end portion of the elongate lock member when the elongate lock member is in its locking position. The distal end portion of the elongate lock member disengages the latch receiver when the elongate lock member is in its unlocking position, to permit the movable access door to be moved to an open position. The bulk storage tank includes at least one port in its side wall, and the housing covers the at least one port when the housing is positioned at the bulk storage tank.

In one aspect, the housing includes an attachment device for releasably coupling the housing to the bulk storage tank.

In another aspect, the bulk storage tank includes a tank support member at the side wall, the tank support member having the attachment device connected thereto for securely coupling the housing to the bulk storage tank.

In yet another aspect, the bulk storage tank includes a dispensing device at or near one end of the bulk storage tank, the dispensing device including a nozzle coupled to a flexible conduit and being releasably coupled to a nozzle support, which is coupled to the side wall of the bulk storage tank. The dispensing device is configured for dispensing liquid from the bulk storage tank. Optionally, the first movable access door substantially prevents the nozzle from being removed from the nozzle support when the first movable access door is pivotably coupled at or near an end of the housing corresponding to the end of the bulk storage tank having the dispensing device and when the first movable access door is closed.

In still another aspect, at least a portion of the housing overhangs an end of the bulk storage tank so that a portion of the cavity is accessible between the first movable access door in its closed position and the bulk storage tank. Optionally, the flexible conduit of the dispensing device exits the cavity at the cavity portion that is accessible between the first movable accessible door and the bulk storage tank.

In a further aspect, the security device further includes a housing extension insert that is positionable between the forward and rearward portions of the housing. The housing extension insert includes a pair of spaced extension side panels and a top extension panel, which correspond to the other side panels and top panels of the housing.

Thus, the present invention provides a security device and/or secure storage tank system including a lockable housing that covers the vulnerable portions of a bulk storage tank, and which permits selective access to the vulnerable portions of the tank through at least two apertures. At least one of the apertures may be readily accessible by an operator standing on the ground or support surface. The ground-accessible aperture is selectively covered by a lockable door that, when unlocked and opened, permits access to a movable elongate lock member. When the elongate lock member is moved to an unlocking position, which can only be accomplished when the ground-accessible door is opened, the elongate locking member disengages a door at the second aperture to permit the second door to be opened for access to the tank through the second aperture. Thus, substantially all of the vulnerable portions of a bulk storage tank may be secured using a single lock, which is accessible without climbing atop the tank, and which permits access to portions of the tank and also to a movable elongate lock member to permit further access to other portions of the tank.

These and other objects, advantages, purposes, and features of the present invention will become apparent upon review of the following specification in conjunction with the drawings.

DESCRIPTION OF THE PREFERRED EMBODIMENTS

The present invention is directed to a security device for bulk storage containers or tanks. Such storage tanks or containers may include multiple ports or access points along a top surface, such as for attachment of accessories such as a pump, a volume indicator, a fill port, and one or more vents, each of which provides a potential access point to a tank's contents by unauthorized persons. Although each of these accessories may be individually locked or secured, unlocking the accessories for use by an authorized operator may require the operator to climb atop the tank (or to climb a ladder to access the top of the tank) at multiple locations, and may require the use of several different keys to unlock and access different accessories along the tank.

The security device of the present invention may be positioned atop a conventional bulk storage container, such as an above-ground fuel tank, to cover and secure the vulnerable accessories and the associated ports to which they are attached. The security device facilitates authorized access to at least some of the accessories (such as a fluid or fuel pump that is frequently used), possibly without need to climb atop the tank or upon a ladder for such access. In effect, most or all of the locking functions of the security device may be performed at a single location, to provide access to the accessories of the tank by an operator positioned on a support surface, and without need for the operator to climb or to unlock multiple different locks at different locations along the tank.

The security device of the present invention secures substantially all of the vulnerable portions of a bulk storage tank while permitting selective access to portions of the tank through two or more apertures in the security device. An operator may obtain access through the two or more apertures of the security device by unlocking a lock that is readily accessible at a door covering a first of the apertures, opening the door after unlocking it, and actuating an elongate lock member to unlatch or unlock a second door covering the second aperture. While the present invention is described with reference to an above-ground bulk fuel storage tank, it should be understood that the same or similar principals may be used for other storage containers with access points that are vulnerable to unauthorized access or tampering, such as underground tanks or storage containers, and for storage tanks or containers adapted for storage and dispensing of liquids or solid bulk materials.

Figure 1:
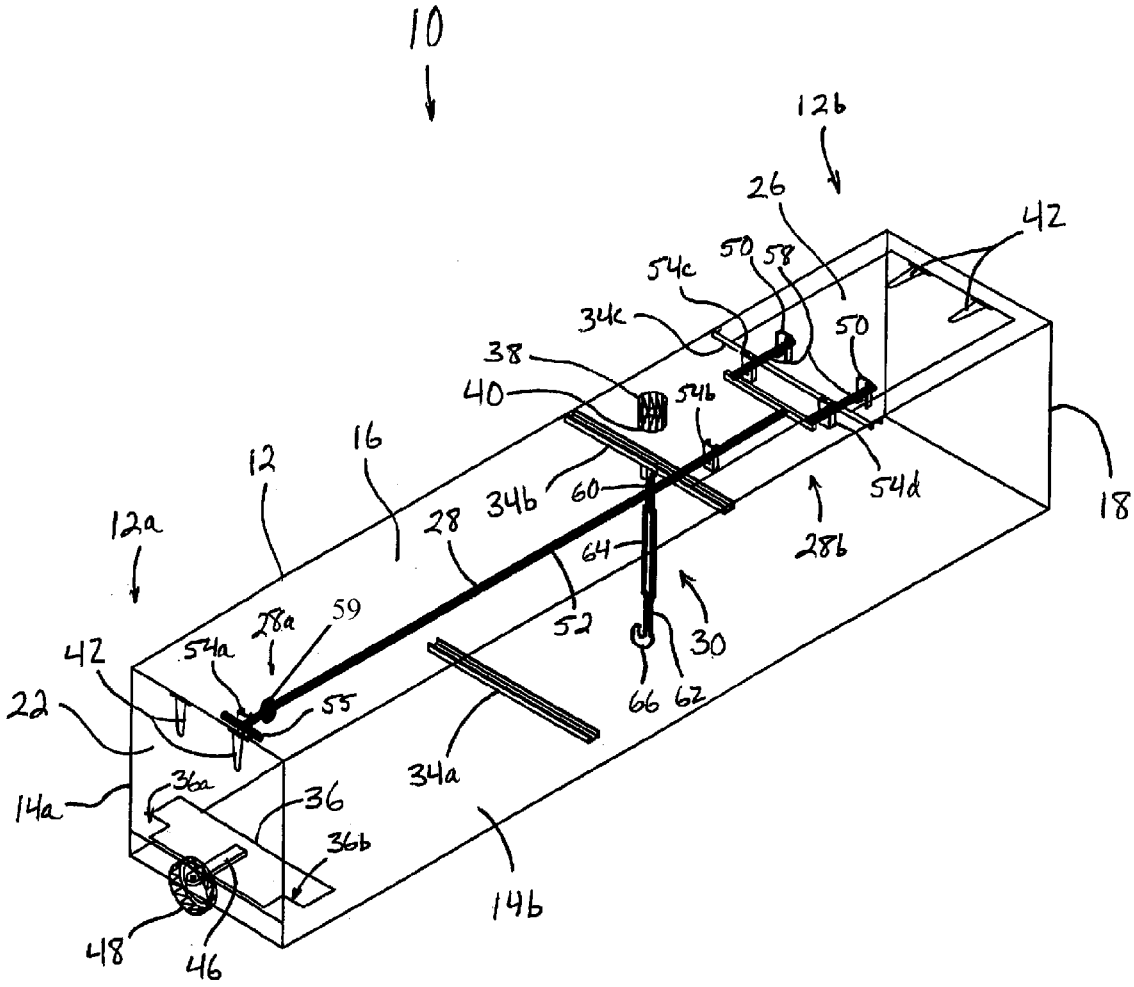
FIG. 1 is a perspective view of a security device in accordance with the present invention.
Figure 2:
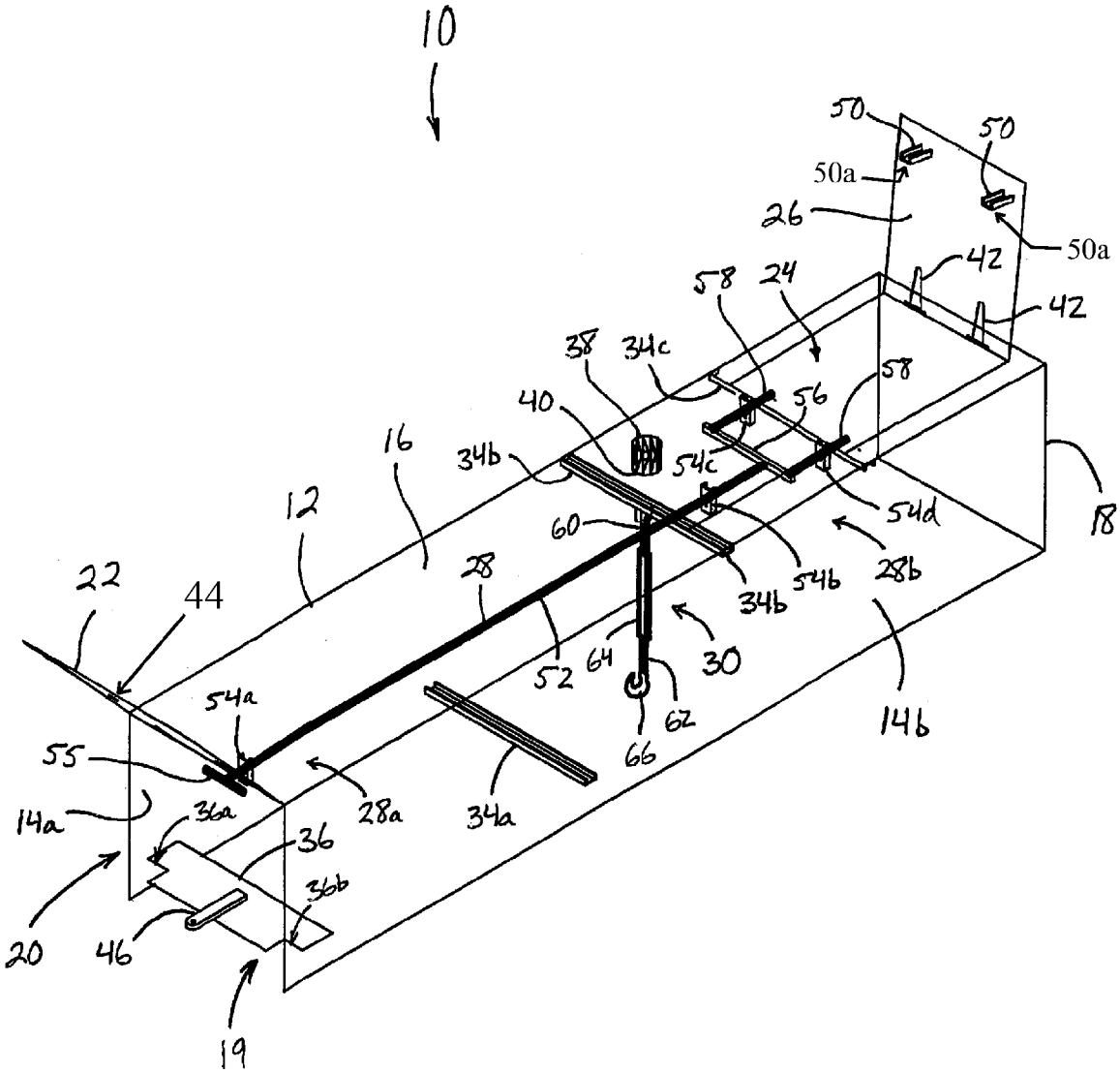
FIG. 2 is another perspective view of the security device of FIG. 1, with its doors in their respective open positions.

Referring now to FIGS. 1 and 2, a security device 10 includes a housing 12 having a pair of spaced side panels 14*a*, 14*b*, a top panel 16, and a rear panel 18. Side panels 14*a*, 14*b*, top panel 16, and rear panel 18 cooperate to define a box with an open bottom and forming a cavity 19 that is adapted to receive a plurality of components disposed along the top portion of a bulk storage tank, as will be described in greater detail below. Respective front edges of side panels 14*a*, 14*b* and top panel 16 cooperate to define a first or front opening or aperture 20 (FIG. 2) that is selectively covered by a first or front movable access door 22. Top panel 16 defines a second, rear, or top aperture 24 at a rearward portion thereof, which is selectively covered by a second movable access door 26. When first door 22 and second door 26 are open, cavity 19 is accessible through the first and second apertures 20, 24, respectively. Security device 10 may be made of cut, formed, and welded steel sections or sheets, for example, or substantially any other sufficiently strong and corrosion-resistant material including other metals or even non-metals such as fiber-reinforced resinous materials.

Inside of housing 12 are located an elongate lock member 28 for selectively locking and unlocking second movable access door 26, and an attachment device 30 for releasably coupling housing 12 to a bulk storage container 32 (FIGS. 3 and 4) such as an above-ground fuel storage tank. Security device 10 further includes support braces 34*a-c* that are coupled between side panels 14*a*, 14*b* to provide strength and/or structural rigidity to housing 12. A locking plate 36 also spans between side panels 14*a*, 14*b*, near first aperture 20, and limits access to cavity 19 when security device 10 is positioned along bulk storage container 32 in a manner that a front portion 12*a* of housing 12 overhangs the container 32. Optionally, a vent fitting 38 is positioned at a vent aperture 40 in top panel 16 to accommodate tank venting. A vent pipe 86 (FIGS. 3 and 4) may be coupled to vent fitting 38 and extend upwardly therefrom, and includes a contaminant-resisting down-turned end portion 86*a*. Vent pipe 86 and vent fitting 38 are in fluid communication with container 32 and the surrounding atmosphere in order to vent the container 32, as will be described in greater detail below.

First movable access door 22 and second movable access door 26 are each pivotably attached to top panel 16 via respective hinges 42. Hinges 42 may be attached to respective inner surfaces of first door 22, second door 26, and top panel 16, such as to limit or prevent tampering with the hinges. In the illustrated embodiment, when first door 22 is closed (FIG. 1), it is aligned substantially vertically at a front end portion 12*a* of housing 12 and is disposed between respective front edge portions of side panels 14*a*, 14*b* and top panel 16. Second door 26 is substantially horizontal when closed (FIG. 1), and may be at least partially supported in the horizontal closed position (substantially coplanar with top panel 16), by resting upon support brace 34*c*.

First door 22 and second door 26 may each be locked and/or latched in their respective closed positions to substantially preclude access to cavity 19 via first aperture 20 and second aperture 24, respectively. First door 22 includes a locking tab aperture 44 (FIG. 2), which receives a locking tab 46 mounted to blocking plate 36 when first door 22 is closed. With first door 22 closed, locking tab 46 projects through locking tab aperture 44 and receives a lock 48 (such as a padlock) that is releasably attachable to a portion of the locking tab 46 extending outwardly from first door 22. It will be appreciated that substantially any type of lock or lockable mechanism may be used to selectively lock the first door in its closed position, without departing from the spirit and scope of the present invention. Second door 26 includes a pair of spaced latch receivers 50 disposed along an inner surface of second door 26, which face cavity 19 when second door 26 is closed. Each of latch members 50 has a respective aperture 50*a* (FIG. 2) for receiving respective end portions of elongate lock member 28, as will be described in greater detail below. Second movable access door 26 includes a handle 51 (FIGS. 3 and 4) to facilitate opening the door 26 and moving it to the open position.

Blocking plate 36 prevents first door 22 from being moved substantially inwardly into cavity 19. Blocking plate 36 is a substantially planar member that spans between side panels 14*a*, 14*b*, and which supports locking tab 46, and which may include notches or recesses 36*a*, 36*b* to provide a limited passageway or access to cavity 19 when first movable access door 22 is closed, such as will be described below.

Elongate lock member 28 includes a proximal end portion 28*a* disposed toward front portion 12*a* of housing 12, and a distal end portion 28*b* disposed toward a rear portion 12*b* of housing 12. Elongate lock member 28 includes a main shaft 52 that is slidably supported in a pair of spaced support members 54*a*, 54*b* coupled to the inner surface of top panel 16. A T-handle 55 at proximal end portion 28*a* of elongate lock member 28 (attached to main shaft 52) is located between support member 54*a* and first door 22 when the door 22 is closed, which corresponds to a locking position of elongate lock member 28. At the opposite end of main shaft 52 is a spreader bar 56 arranged perpendicularly at the end of main shaft 52. Spreader bar 56 has a pair of spaced lock shafts 58 that are parallel to main shaft 52 and spaced to engage latch members 50 at their respective apertures 50*a*. Each spaced lock shaft 58 is supported by a corresponding support member 54*c*, 54*d* to maintain proper alignment of lock shafts 58 with apertures 50*a* of latch members 50 and to limit rotation of main shaft 52, while permitting axial translation or movement of main shaft 52 and spaced lock shafts 58.

Figure 3:
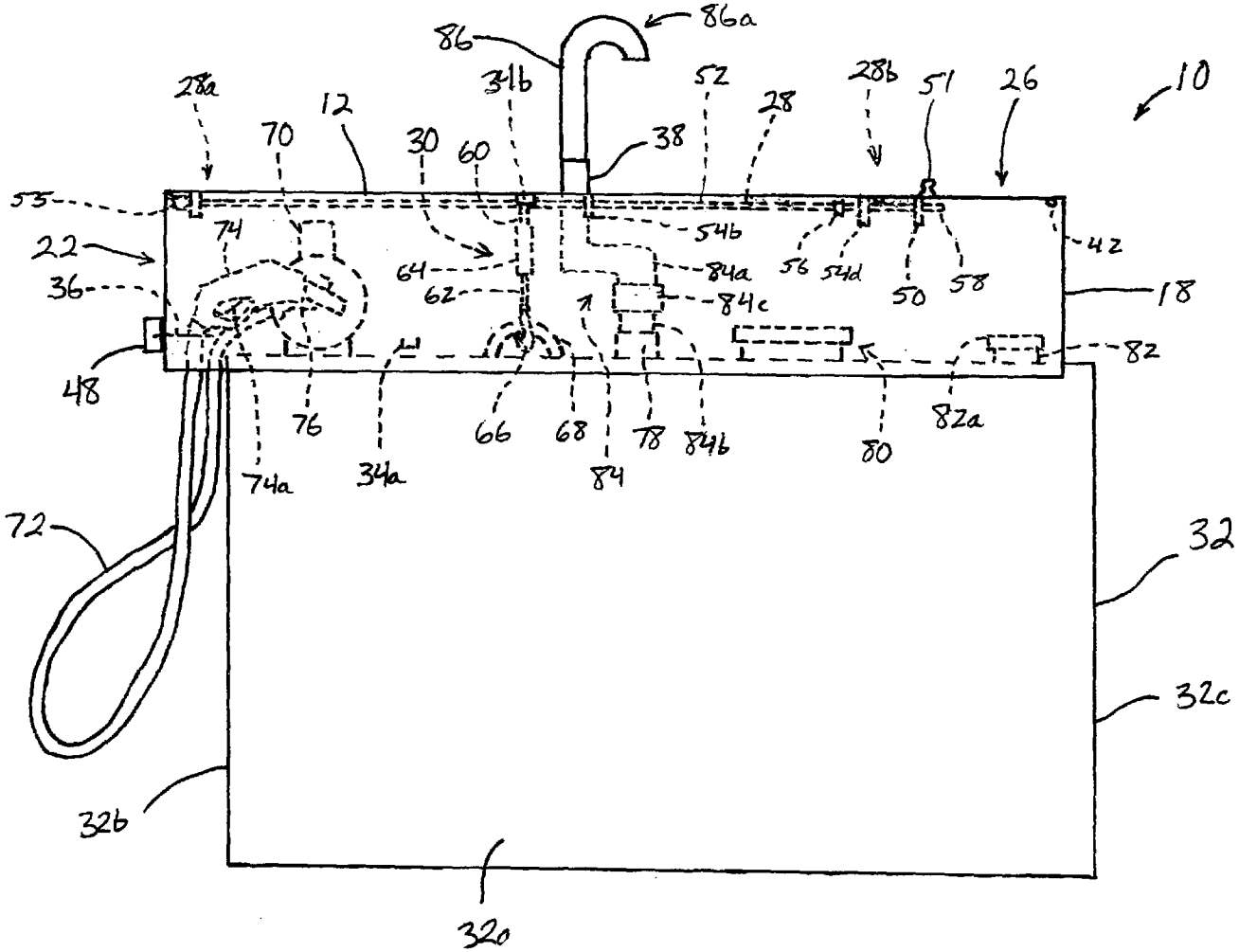
FIG. 3 is a side elevation of the security device of FIG. 1 positioned atop a bulk fuel storage tank.

With first door 22 closed (FIGS. 1 and 3), spaced lock shafts 58 are disposed in the apertures 50*a* of latch members 50 on second door 26, to hold the second door 26 in the closed position. This corresponds to the "locking position" of elongate lock member 28, and it will be observed that T-handle 55 is in close proximity (or adjacent or abutting) to an inner surface of first door 22 when the first door 22 is closed and blocking T-handle 55 (FIGS. 1 and 3). With first door 22 held closed, elongate lock member 28 cannot be moved to the unlocking position of FIGS. 2 and 4 without opening the first door 22.

Optionally, a stop member 59 (FIG. 1) may be attached to main shaft 52 of elongate lock member 28 near proximal end portion 28*a*, and positioned on the opposite side of support member 54*a* from T-handle 55, to limit the extent to which elongate lock member 28 may be pulled or moved outwardly to the unlocking position. Stop member 59 may be a threaded nut or flange having greater diameter than main shaft 52 so that the stop member 59 cannot be readily passed through support member 54*a*.

Figure 4:
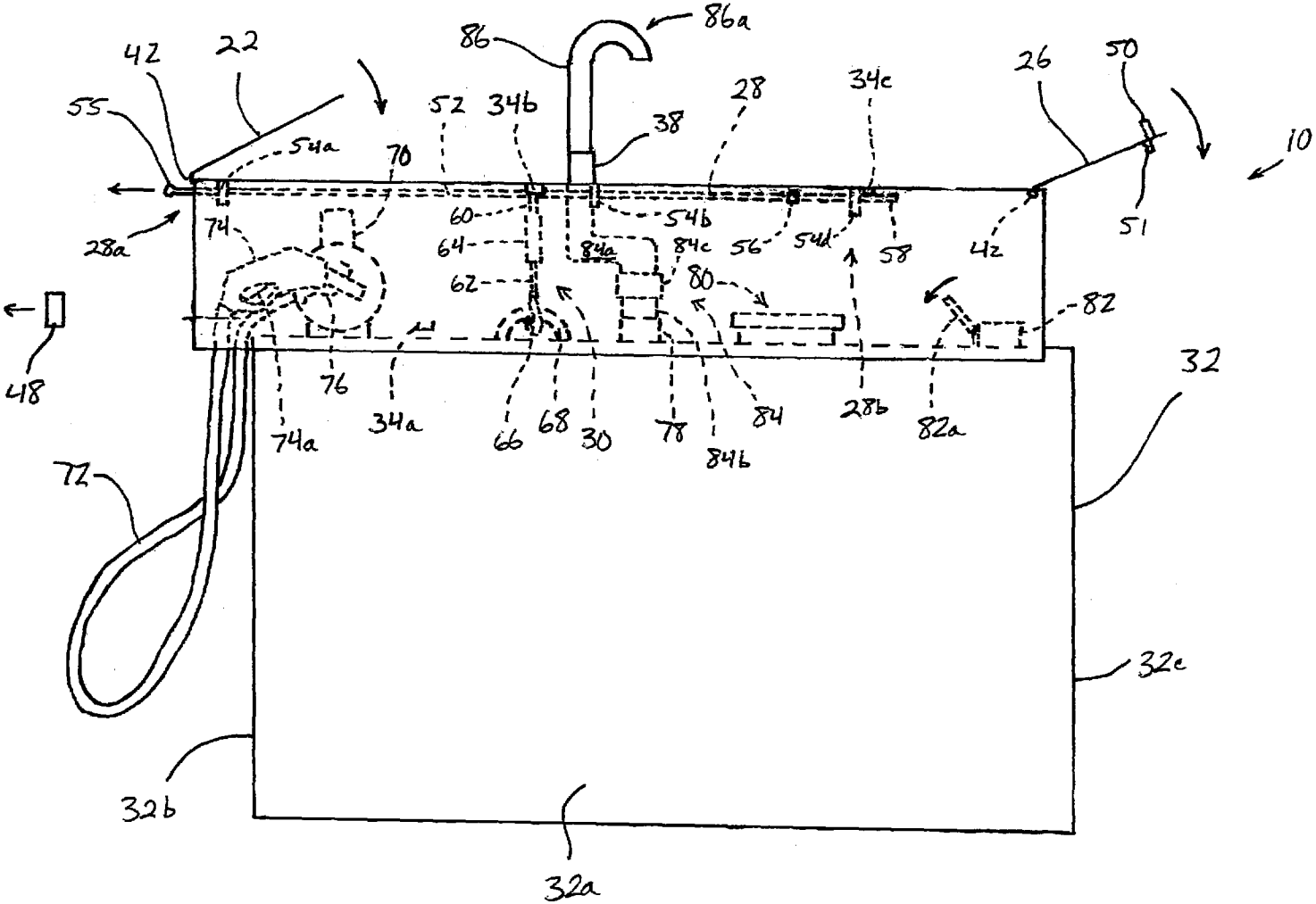
FIG. 4 is another side elevation of the security device and bulk storage tank of FIG. 3, showing the movable doors in their respective open positions.

In the illustrated embodiment, elongate lock member 28 is supported by support members 54*a-d* at top panel 16 in a manner that permits the elongate lock member 28 to be manually moved between the locking position of FIGS. 1 and 3, and the unlocking position of FIGS. 2 and 4. In the unlocking position, proximal end portion 28*a* of elongate lock member 28 (including T-handle 55) extends through first aperture 20 to draw spaced lock shafts 58 out of their respective latch members 50 of second door 26. Once second door 26 is again closed, elongate lock member 28 may be moved to its locking position so that spaced lock shafts 58 are again received in the apertures of latch members 50 to lock second door 26 in its closed position. In the locking position, proximal end portion 28*a* of elongate lock member 28 is once again disposed entirely inside of cavity 19 so as not to project through first aperture 20, and so that first door 22 may be closed and locked, thus preventing elongate lock member 28 from being moved back to the unlocking position.

Attachment device 30 releasably couples housing 12 to bulk storage container 32, and is accessible through at least one of first aperture 20 and second aperture 24 when the respective first movable access door 22 or second movable access door 26 is open, which limits or prevents unauthorized access to attachment device 30. In the illustrated embodiment, attachment device 30 includes an upper fixed-length member 60, a lower fixed-length member 62, an adjustable-length member 64, and an attachment portion 66 for engaging a portion of bulk storage container 32. Upper fixed-length member 60 is attached at its upper end to support brace 34*b* and is attached at its lower end to adjustable-length member 64. Lower fixed-length member 62 is attached at its upper end to adjustable-length member 64 and is attached at its lower end to attachment portion 66. Upper member 60 and lower member 62 may each be a length of flexible chain or cable, a rigid member, or the like.

Adjustable-length member 64 is operable to adjust the distance between attachment portion 66 and support brace 34*b* by shortening or lengthening the overall length of attachment device 30. For example, adjustable-length member 64 may be a conventional threaded turnbuckle mechanism that is rotated in one direction or the other about its longitudinal access to draw the upper fixed-length member 60 and the lower fixed-length member 62 toward one another, or to permit the fixed-length members to be further separated. Attachment portion 66 may be a hook-shaped member as shown, or substantially any other device or member capable of releasably coupling to a bulk storage container, such as at a loop 68 provided along a top surface of container 32, such as may be conventionally provided on such containers for lifting and/or transporting the containers.

It will be appreciated that an attachment device with or without fixed-length members would still be generally operable in the manner described above as long as an adjustable-length member (similar to member 64) is provided between an attachment portion (e.g. hook 66) and A support brace or other attachment location along the housing. Attachment devices without adjustable-length members are also envisioned, such as a device utilizing an openable and closeable clasp at the end of a fixed-length member, or by positioning a cross bar or other device so as to engage both the housing of the security device and a portion of the bulk storage container. Optionally, the housing of the security device may be permanently or removably attached to a bulk storage container by welding directly to the container (such as during manufacturing of the container), or by bolting the housing to the container using fasteners that are accessible from inside the cavity defined by the housing, for example, without departing from the spirit and scope of the present invention. For example, one such attachment device, which lacks an adjustable-length member, is described below with reference to FIGS. 7, 8, and 11-14.

In the illustrated embodiment of FIGS. 1-4, bulk storage container 32 has a generally cylindrical sidewall 32*a* having a generally horizontal longitudinal axis and circular end caps 32*b*, 32*c* to form a cylindrical tank bulk storage container for containing and dispensing liquids such as liquid fuels. Bulk storage container 32 includes loop 68 at a top portion of sidewall 32*a*, which is typically provided on such tanks or containers to facilitate lifting and repositioning of the container using an overhead crane or the like. A dispensing device 70, such as a fluid pump, is provided along a top surface of container 32 near end cap 32*b* for pumping fuel out of the container, through a flexible hose or conduit 72, through a nozzle 74 (which may contain an internal valve that is actuatable by a trigger 74*a*), and into a receptacle such as a vehicle fuel tank or portable fuel container. The notches or recesses 36*a*, 36*b* of blocking plate 36 are sized to receive portions of hose 72 when first movable access door 22 is closed, which permits the door 22 to close without pinching the hose 72 against blocking plate 36. Pump 70 includes a cradle or nozzle support 76 for supporting nozzle 74 when the nozzle is not in use. When the nozzle 74 is positioned on the cradle 76 and first movable access door 22 is closed, nozzle 74 cannot be removed from cradle 76 because first movable access door 22 prevents the nozzles' complete removal or disengagement from cradle 76. With first movable access door 22 open, nozzle 74 is free to be removed from cradle 76 for use in dispensing the fuel or other liquid from container 32.

Container 32 may further include a conventional vent 78 for equalizing the air pressure inside of container 32 with that of the surrounding atmosphere, a safety vent 80 to reduce the likelihood of explosion of container 32 in the event of fire, and a fill port 82 that is readily accessible through second aperture 24 to permit refilling of container 32. Fill port 82 includes a lid 82*a* that is movable (such as by pivoting) to an open position (FIG. 4) for filling the container 32 via second aperture 24 in housing 12. This may be accomplished, for example, by an operator positioned above container 32 and accessing lid 82*a* through second aperture 24 of housing 12.

A vent conduit 84 may be provided with security device 10 to provide fluid communication between conventional vent 78 and vent fitting 38 on housing 12. In the illustrated embodiment, vent conduit 84 includes an elbow section 84*a* coupled to a lower straight section 84*b* via a threaded collar, where an upper portion of elbow section 84*a* is adapted to couple to vent fitting 38, and a lower portion of lower straight section 84*b* is adapted to couple to conventional vent 78. Thus, atmospheric air may be directed into container 32 through vent pipe 86, vent fitting 38, vent conduit 84, and vent 78 to equalize the fluid pressure in container 32 while dispensing fuels or other bulk materials.

Accordingly, tank accessories such as pump 70 may be readily accessed and used on a day-to-day basis after removing lock 48 from locking tab 46 and opening first movable access door 22. When desired, other tank accessories such as the fill port 82 may be accessed through second aperture 24 once elongate lock member 28 has been moved to its unlocking position (with door 22 open) so that second movable access door 26 may be opened. Both unlocking functions may be performed by an operator positioned at the front portion 12*a* of the housing. Once the second movable access door 26 is closed, elongate lock member 28 may be moved to its locking position with spaced lock shafts 58 engaging the apertures 50*a* in latch members 50 of second door 26. This may be accomplished by the operator (positioned at front portion 12*a* of housing 12) pushing inwardly on T-handle 55 until the handle is located inside of cavity 19. Thus, the various tank accessories need not be individually secured because they all are covered and protected by housing 12, while authorized access to the accessories is permitted after unlocking functions are performed at a single location near the front portion 12*a* of housing 12.

Optionally, and with reference to FIGS. 5-12, a secure storage tank system 110 includes a security device 112 in combination with a bulk storage container 114. In the illustrated embodiment, security device 112 is functionally similar to security device 10, described above, with security device 112 differing from security device 10 primarily in its part dimensions and/or geometries, and the arrangement of certain components relative to one another. Security device 112 includes a housing 116 assembled from a forward housing portion 116*a* and a rearward housing portion 116*b*, which are arranged end-to-end and coupled together via a plurality of fasteners 118, as best shown in FIGS. 15-17 and 21. Forward housing portion 116*a* has a larger region 120*a* at its forward end, and a tapered region 120*b* at its rearward end. When housing 116 is assembled, tapered region 120*b* of forward housing portion 116*a* abuts the forward end of rearward housing portion 116*b*. Rearward housing portion 116*b* has smaller cross sectional dimensions than the larger region 120*a* of forward housing portion 116*a*, and substantially the same cross sectional dimensions as the rearward end of tapered region 120*b*, so that the cross sectional dimensions of tapered region 120*b* transitions between larger region 120*a* and rearward housing portion 116*b*.

Figure 18:
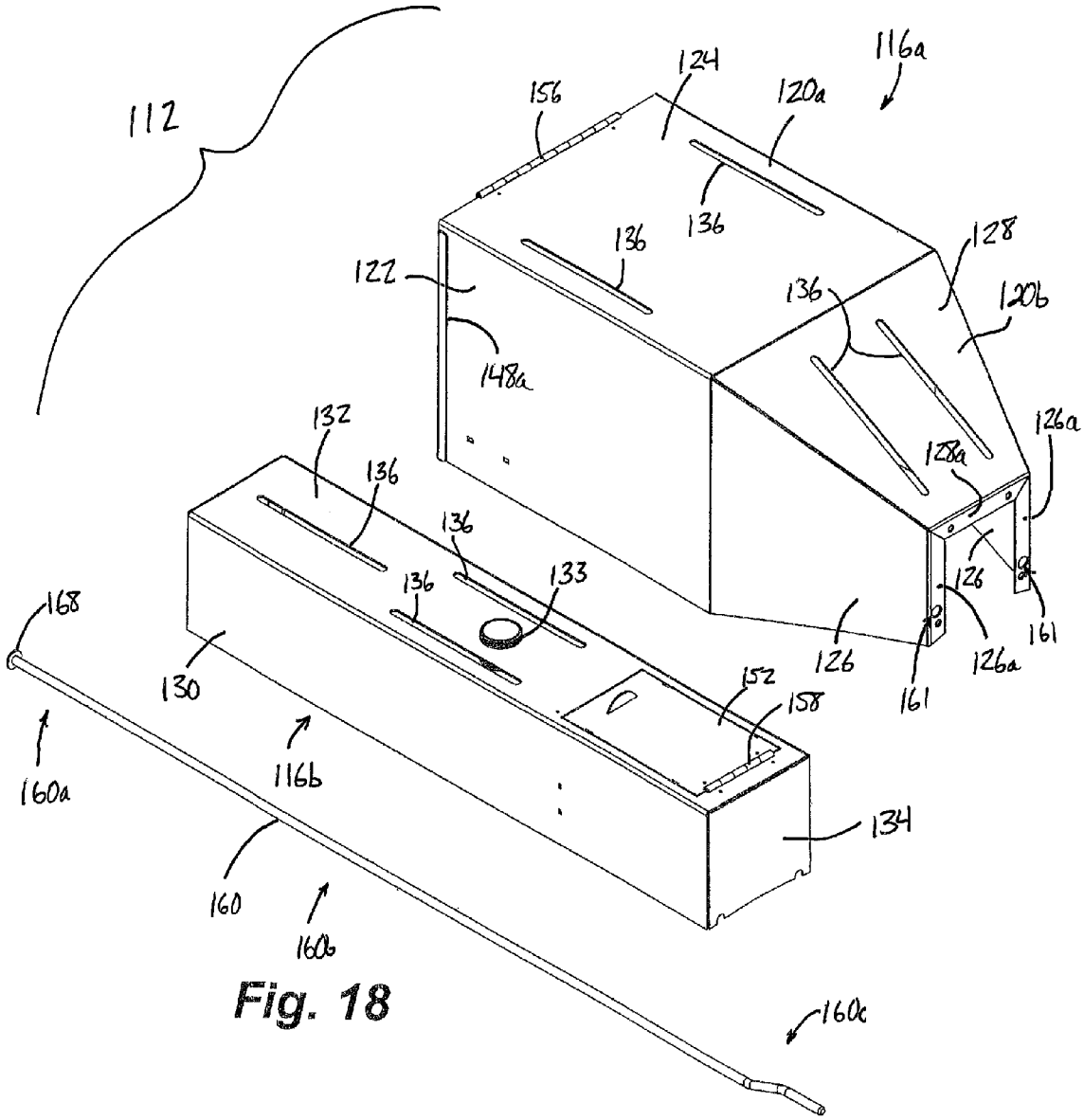
FIG. 18 is a partially-exploded view of the security device of FIGS. 15 and 16.
Figure 19:
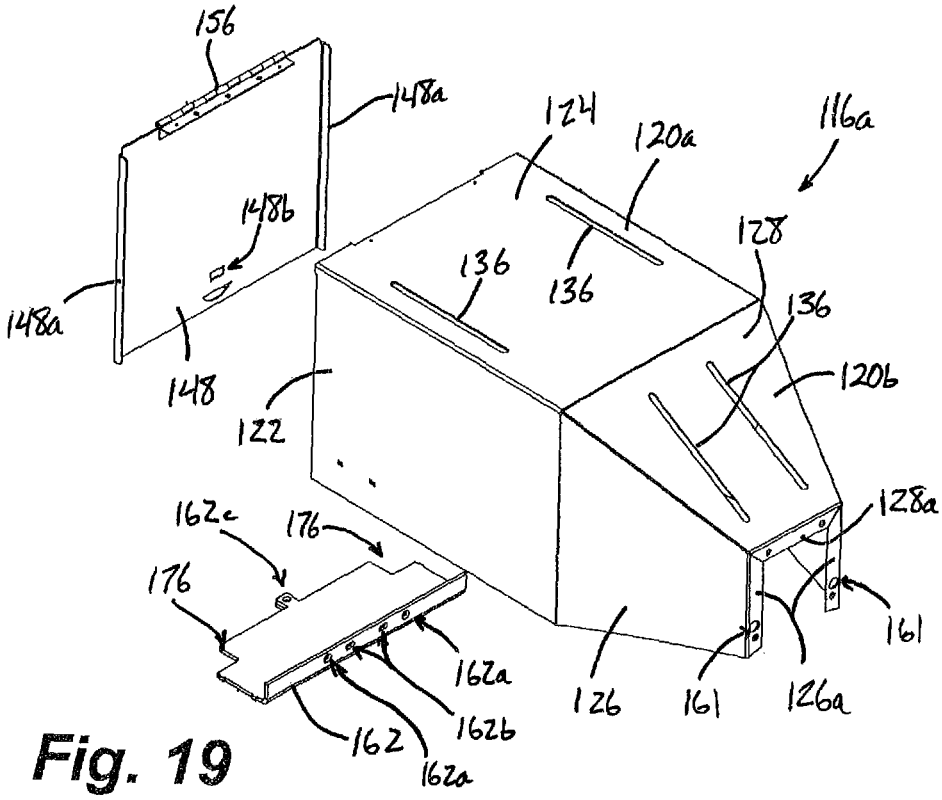
FIG. 19 is an exploded view of a front end portion of the security device of FIGS. 15 and 16.
Figure 20:
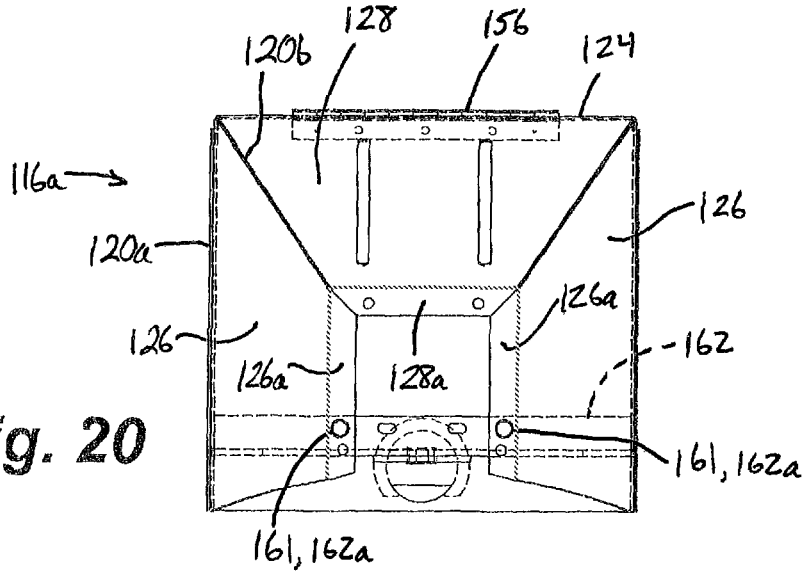
FIG. 20 is a rear end elevation of the front end portion of the security device of FIGS. 15 and 16.

Larger region 120*a* of forward housing portion 116*a* is made up of a pair of parallel spaced opposite side panels 122 joined at their top edges by a top panel 124 (FIGS. 18-20). Tapered region 120*b* of forward housing portion 116*a* is made up of a pair of trapezoidal side panels 126 that are spaced more closely together at their rearward edges (i.e. where they meet the forward end of rearward housing portion 116*b*) than at their forward edges (i.e. where they meet side panels 122 of larger region 120*a* of forward housing portion 116*a*). Tapered region 120*b* includes a trapezoidal top panel 128 extending rearwardly from top panel 124 and spanning between the top edges of trapezoidal side panels 126. As best shown in FIGS. 18-20, trapezoidal top panel 128 includes an inwardly or downwardly-extending flange 128*a* at its rearward end, and trapezoidal side panels 126 each include an inwardly-extending flange 126*a* that is used in connecting forward housing portion 116*a* to rearward housing portion 116*b*, as will be described below.

Figure 22:
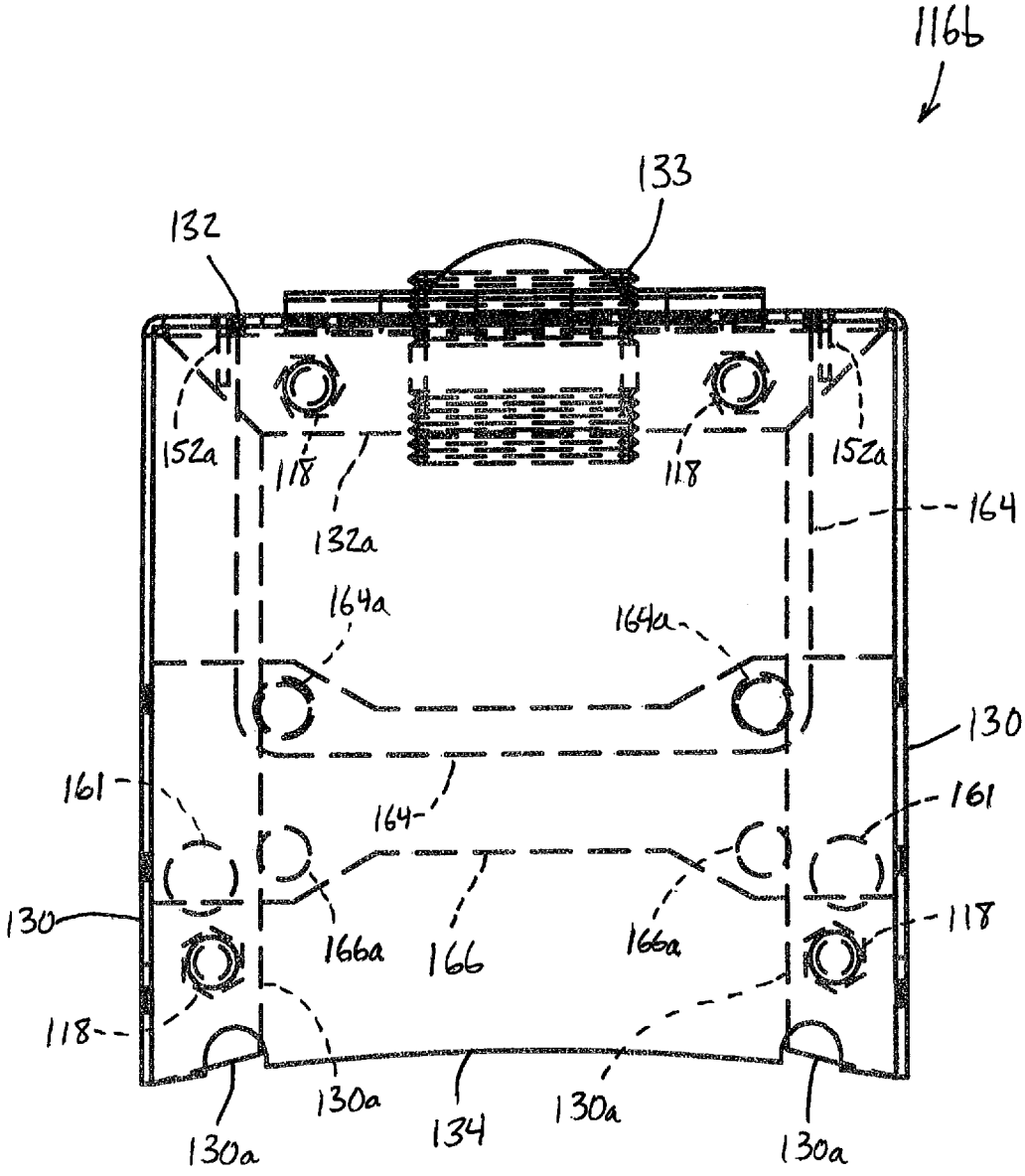
FIG. 22 is a rear end elevation of the rear end portion of the security device of FIGS. 15 and 16.

Rearward housing portion 116*b* is made up of a pair of parallel, spaced, opposite side panels 130 joined at their top edges by a top panel 132, and a rear end panel 134 at the rearward edges of side panels 130 and top panel 132. Top panel 132 includes an opening fitted with a vent pipe fitting 133 that is in fluid communication with an interior vent pipe 135 coupled to vent 144, and that is further in fluid communication with an exterior vent pipe 137 (FIGS. 7, 8, 11, and 12). Opposite side panels 130 and top panel 132 of rearward housing portion 116*b* are smaller in width than opposite side panels 122 and top panel 124 of forward housing portion 116*a*, with tapered region 120*b* transitioning between the dimensions of larger region 120*a* and the dimensions of rearward housing portion 116*b*. Top panel 132 includes an inwardly or downwardly-extending flange 132*a* at its forward end, and side panels 130 each include an inwardly-extending flange 130*a* at their respective forward ends (FIG. 22). Flanges 132*a*, 130*a* of rearward housing portion 116*b* abut the respective flanges 128*a*, 126*a* of forward housing portion 116*a*. The flanges include correspondingly-aligned holes so that forward housing portion 116*a* can be coupled to rearward housing portion 116*b* using mechanical fasteners 118 (FIGS. 15-17 and 22). In the illustrated embodiment, top panels 124, 128, 132 include venting slots 136 that facilitate air flow through the housing 116. Venting slots 136 aid in the prevention of buildups of gases and/or condensation inside the housing 116 and along the top of bulk storage container 114.

Figure 12:
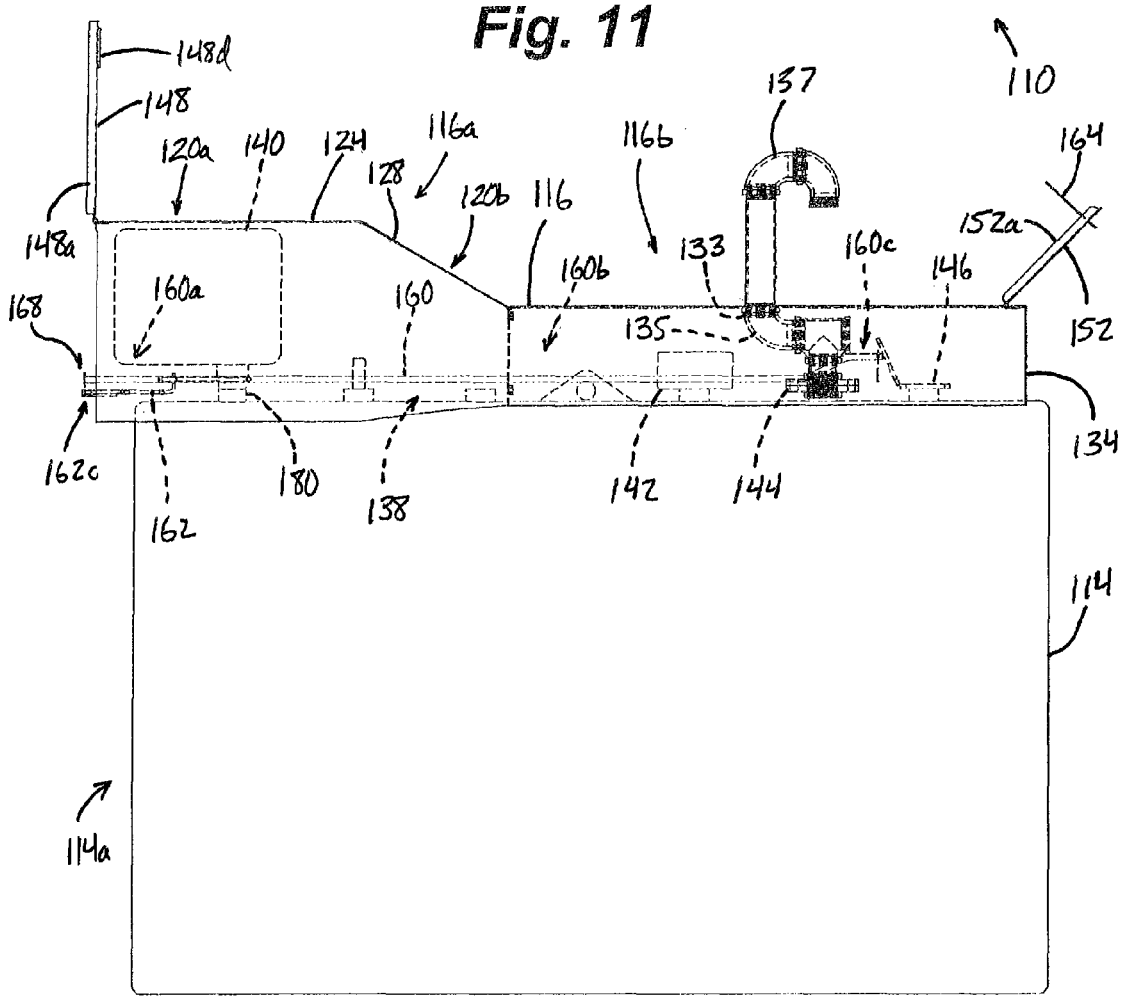
FIG. 12 is a side elevation of the secure storage tank system of FIG. 9.
Figure 21:
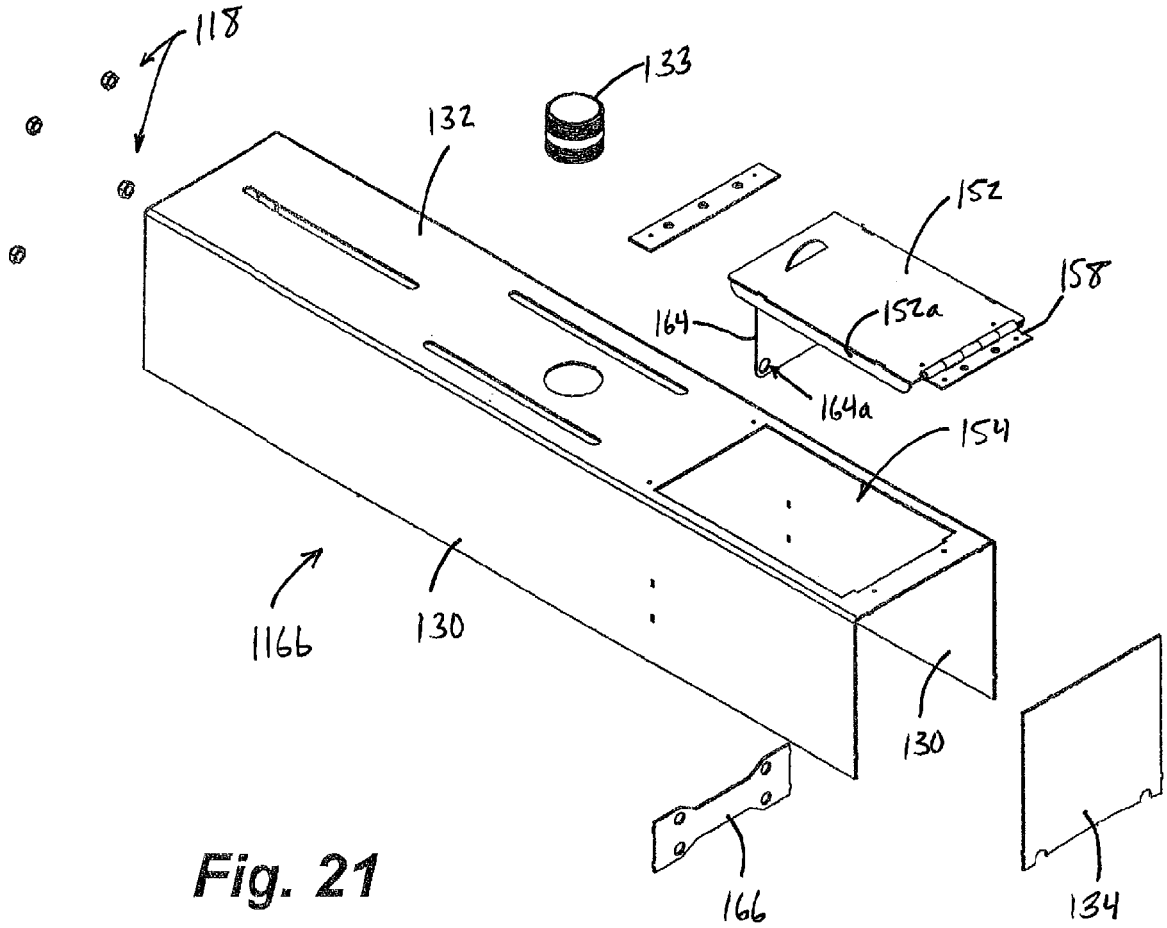
FIG. 21 is an exploded perspective view of a rear end portion of the security device of FIGS. 15 and 16.

Like housing 12 of security device 10, housing 116 is constructed so that it is open at its bottom side to define a cavity 138 that receives various components of bulk storage container 114 (FIGS. 7-9 and 11-17). These components may include, for example, a pump 140, a safety vent 142, a conventional vent 144, and a fill port 146 (FIGS. 7, 8, 11, and 12). Forward housing portion 116*a* includes a forward or first door 148 for selectively covering a front or first aperture or opening 150 to cavity 138 that provides access to at least pump 140, while rearward housing portion 116*b* includes a rearward or second door 152 for selectively covering a rearward or second aperture or opening 154 to cavity 138 that provides access to at least fill port 146. First door 148 is pivotally coupled to top panel 124 via a hinge 156, and second door 152 is likewise pivotally coupled to top panel 132 via a hinge 158 (FIGS. 9-12). Doors 148, 152 operate in substantially the same manner as the respective doors 22, 26 at housing 12, and provide limited access to the components along the top of bulk storage container 114. Optionally, door flanges 148*a*, 152*a* may be included on the respective doors 148, 152 to inhibit tampering with prying tools or the like (FIGS. 12, 18, and 21).

Figure 13:
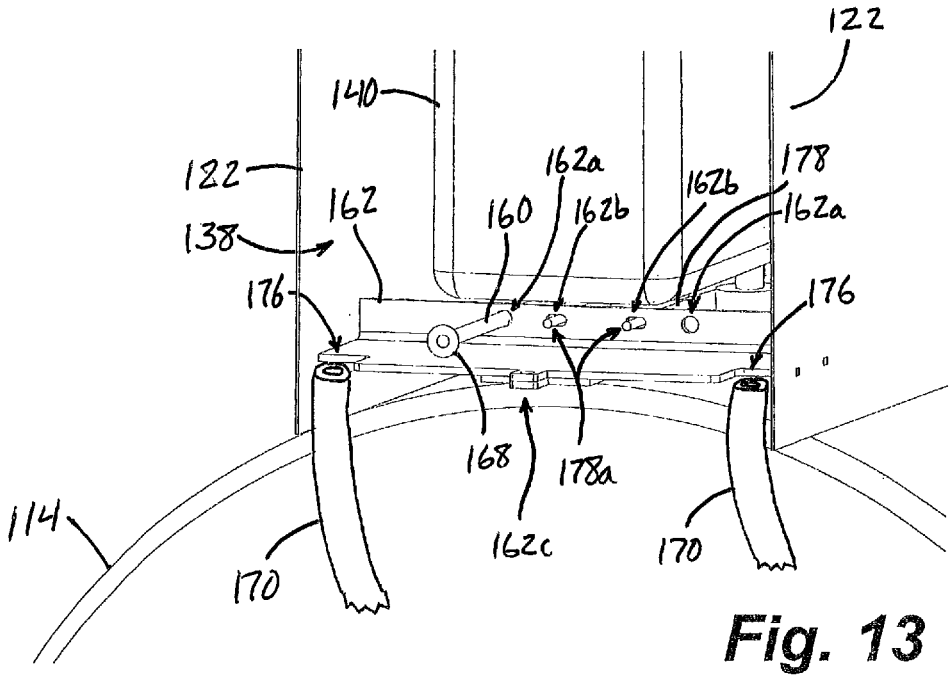
FIG. 13 is an enlarged perspective view of a front portion of the secure storage tank system of FIG. 9.
Figure 14:
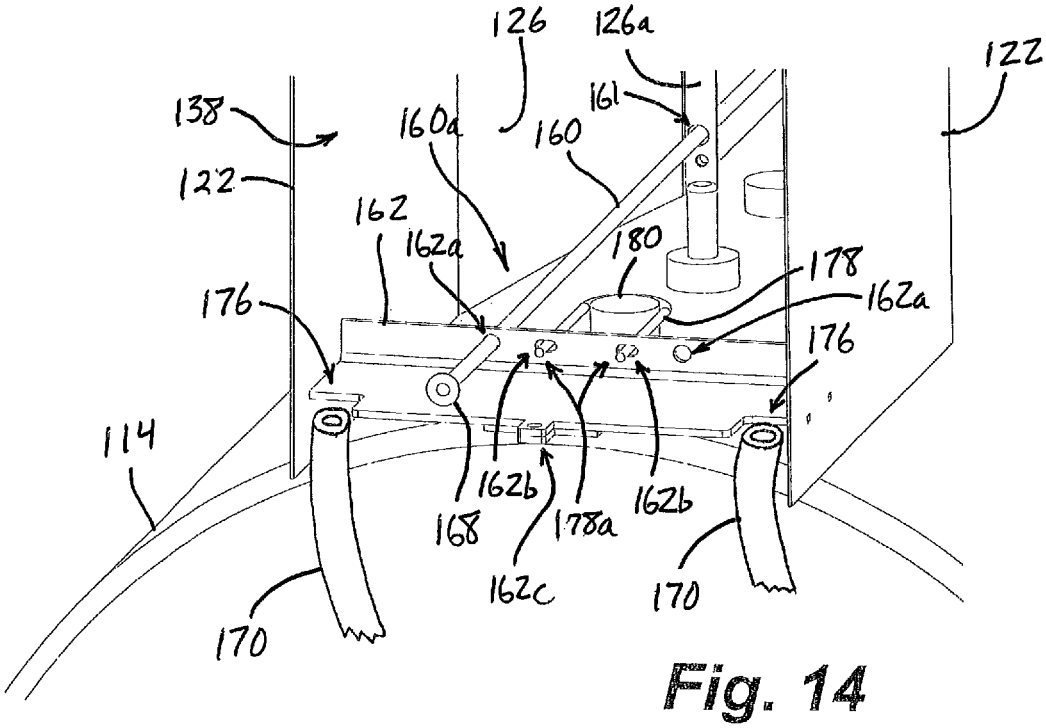
FIG. 14 is another enlarged perspective view of the front portion of the secure storage tank system as in FIG. 13, in which a pump is omitted for clarity.
Figure 15:
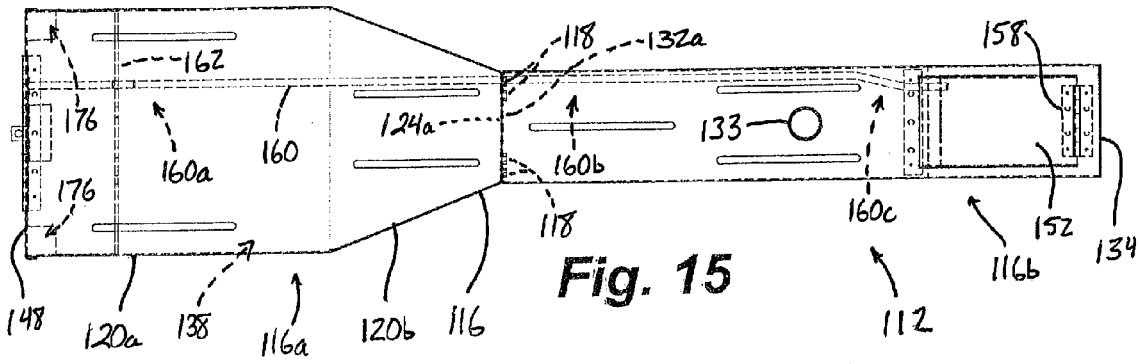
FIG. 15 is a top plan view of the security device that corresponds to the secure storage tank system of FIG. 5.
Figure 16:
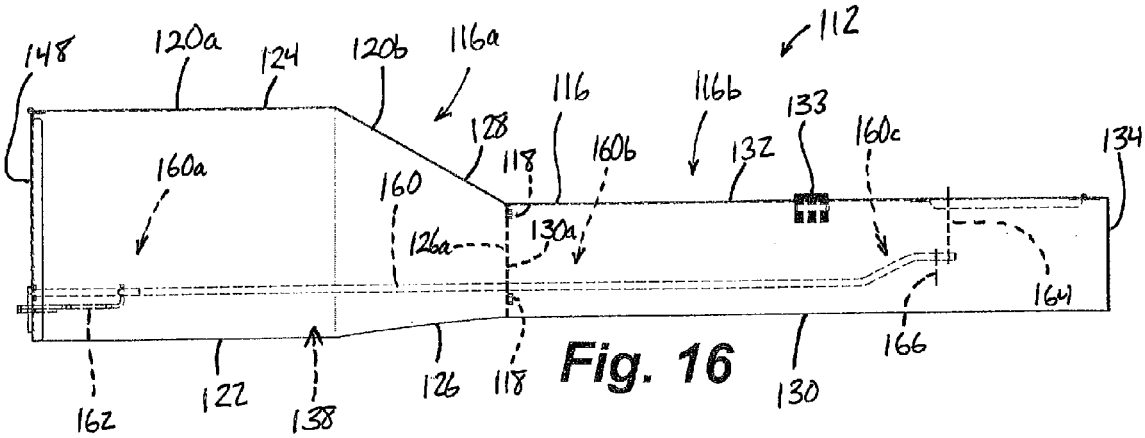
FIG. 16 is a side elevation of the security device of FIG. 15.
Figure 17:
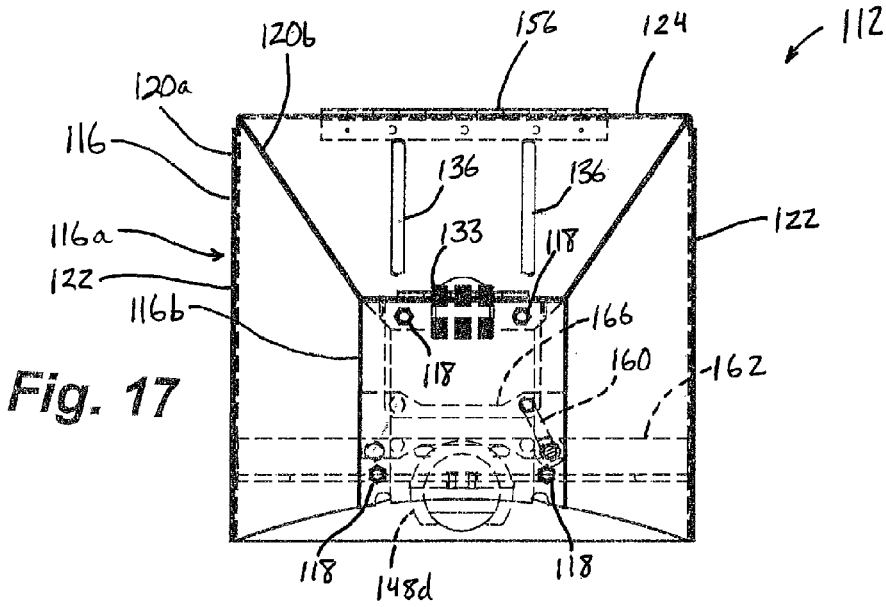
FIG. 17 is a rear end elevation of the security device of FIGS. 15 and 16.

An elongate lock member 160 extends lengthwise or longitudinally inside of housing 116, along a lower region of cavity 138, and has a forward end portion 160*a*, a middle portion 160*b*, and a rearward end portion 160*c*. Elongate lock member 160 is movably supported or guided at its forward end portion 160*a*, which slides or moves through an aperture 162*a* in a locking plate or cross member 162 that spans between side panels 122 near first aperture 150 (FIGS. 13 and 14). Elongate lock member 160 is further supported or guided at its middle portion 160*b* by apertures 161 in flanges 126*a* of the trapezoidal side panels 126 and flanges 130*a* of side panels 130 (FIGS. 16, 18, 20, and 22). In the illustrated embodiment, rearward end portion 160*c* is angled so as to align with and selectively engage an aperture 164*a* in a latch receiver plate 164 that extends downwardly from second door 152. Rearward end portion 160*e* is further supported by an aperture 166*a* in another cross member 166 that extends between side panels 130 just forward of latch receiver plate 164 when second door 152 is closed (FIGS. 16-20). A flange or gripping portion 168 at forward end portion 160*a* of elongate lock member 160 (FIGS. 11-14 and 18) facilitates pushing and pulling on lock member 160 by an operator positioned at the front end of security device 112 when first door 148 is open, to lock and unlock second door 152, respectively.

Figure 5:
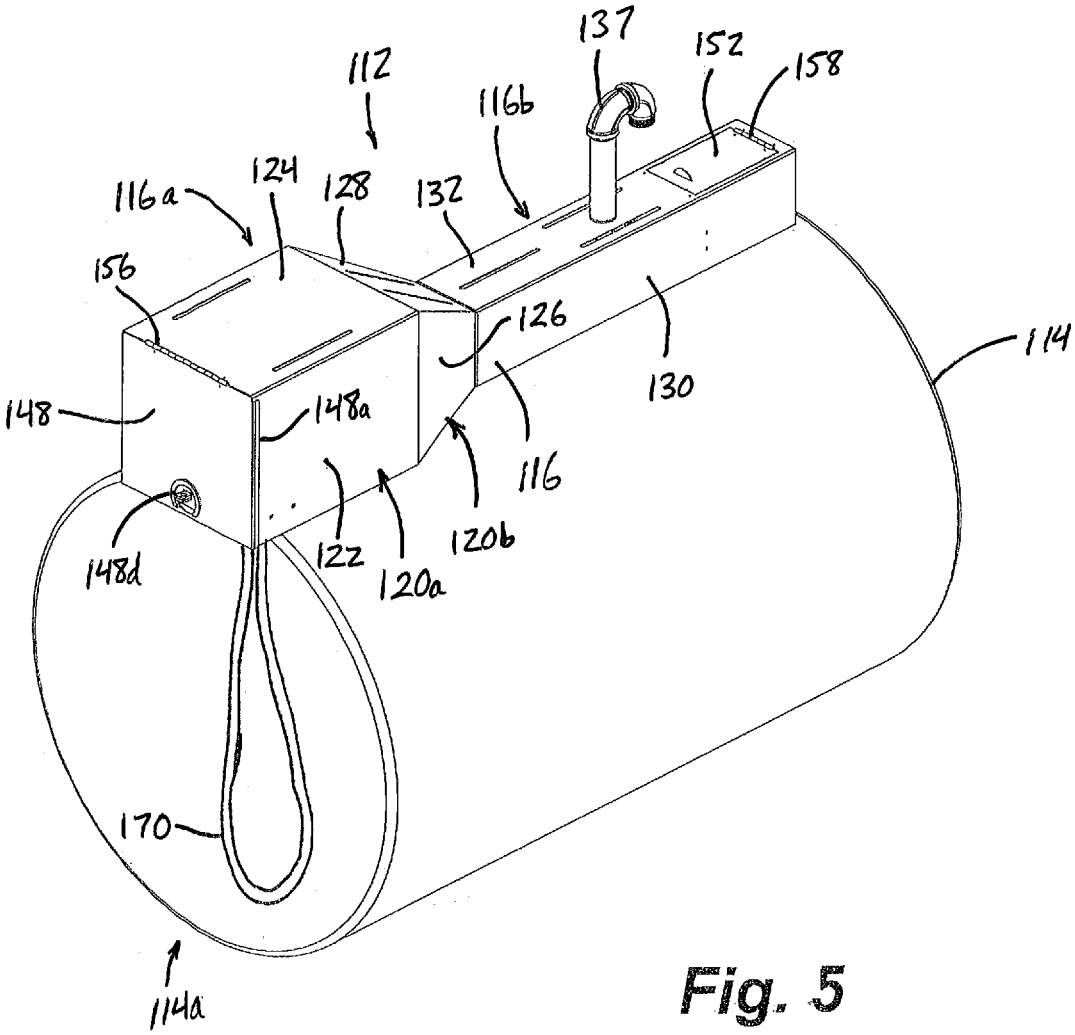
FIG. 5 is a front perspective view of a secure storage tank system including another security device of the present invention.
Figure 6:
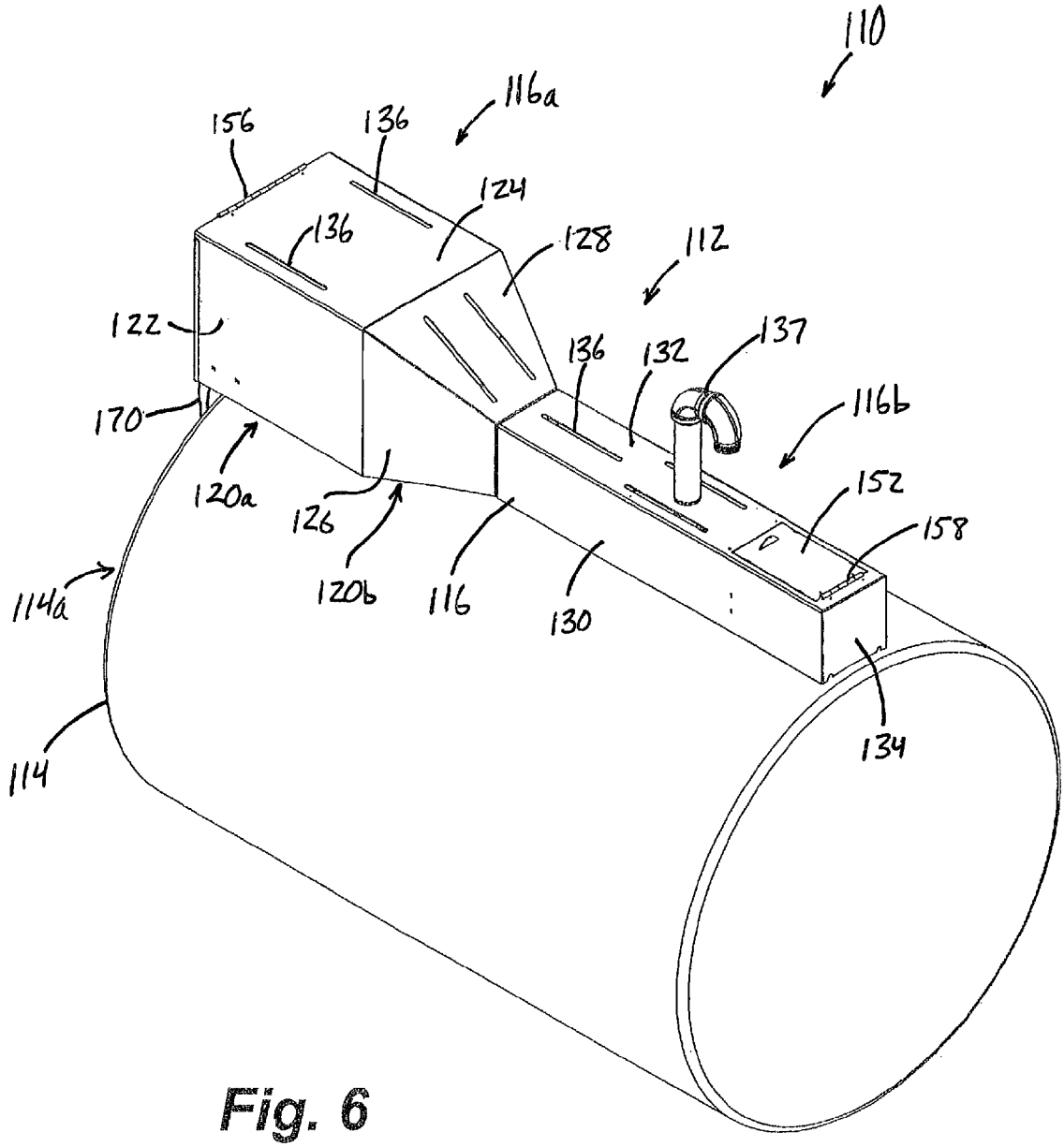
FIG. 6 is a rear perspective view of the secure storage tank system of FIG. 5.
Figure 7:
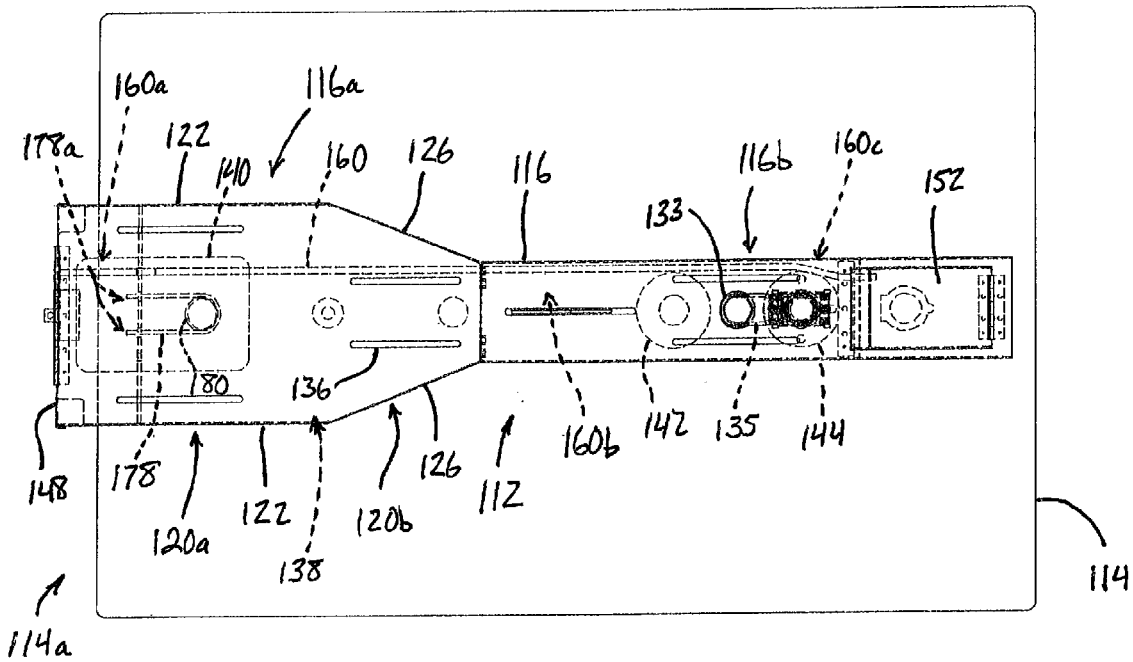
FIG. 7 is a top plan view of the secure storage tank system of FIG. 5.
Figure 8:
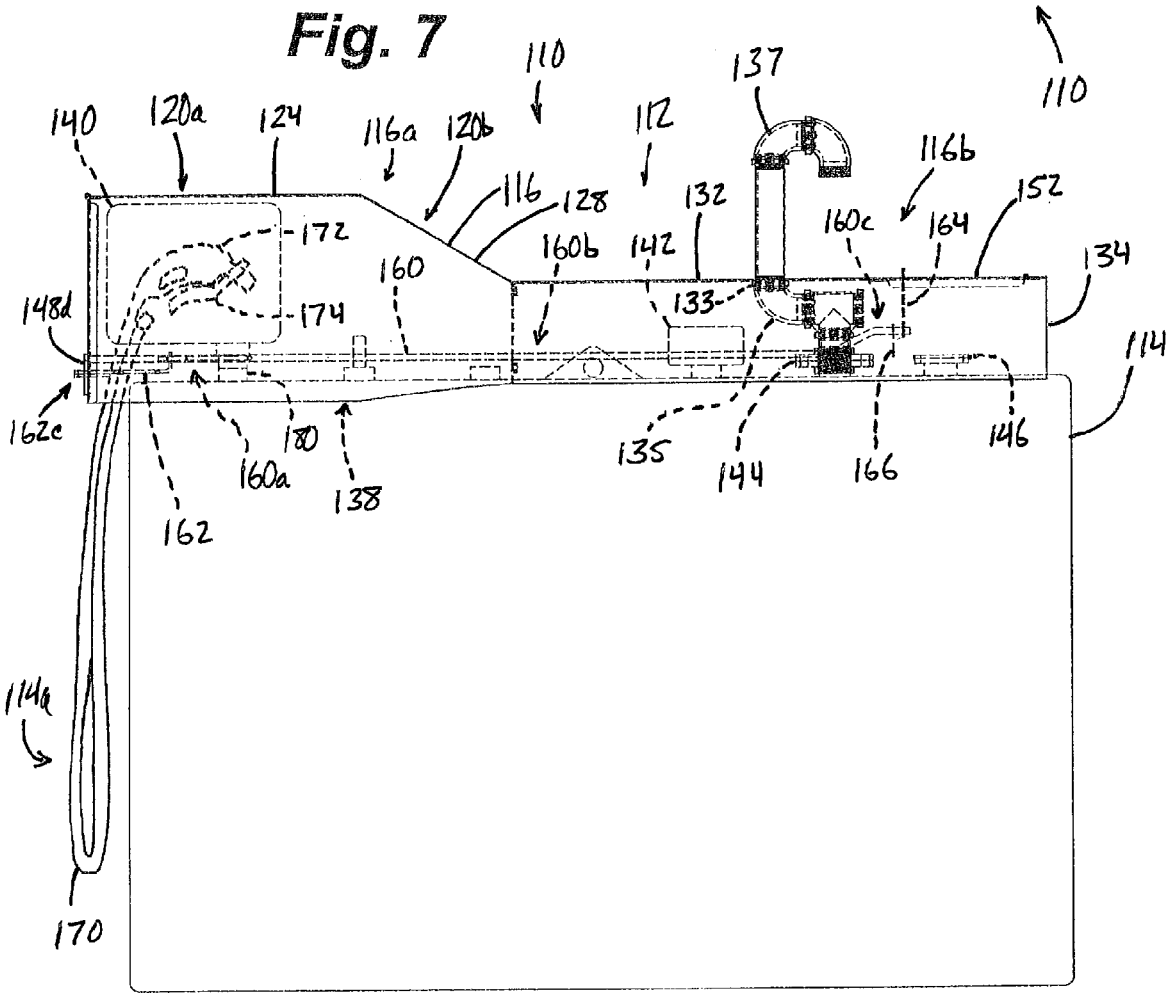
FIG. 8 is a side elevation of the secure storage tank system of FIG. 5.
Figure 9:
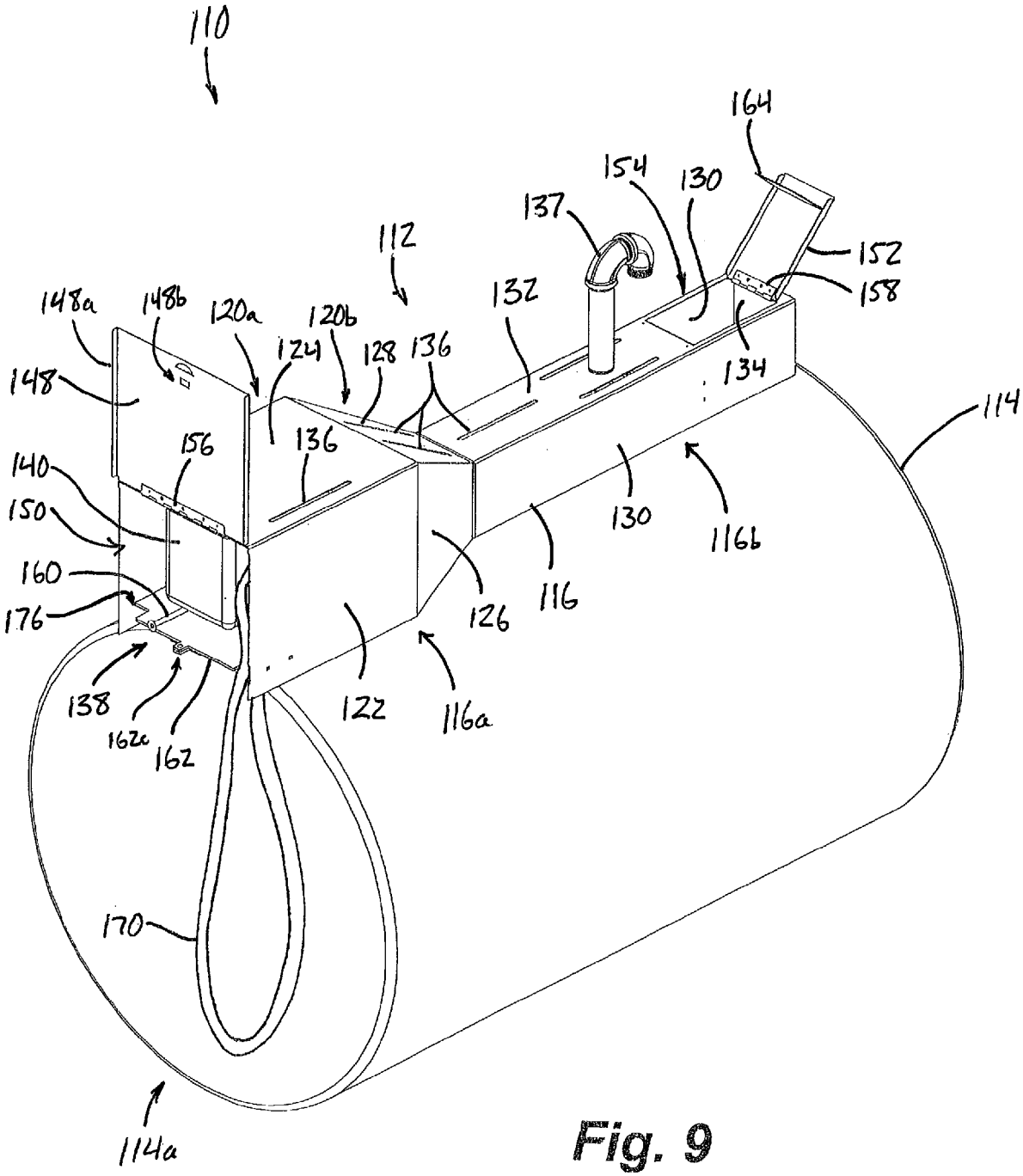
FIG. 9 is another front perspective view of the secure storage tank system of FIG. 5, shown with the movable doors in their respective open positions.

As best shown in FIGS. 7-9, 13, and 14, pump 140 is fitted with a flexible conduit or hose 170 that is in fluid communication with pump 140 and container 114, and which includes a nozzle 172 to facilitate dispensing fluid (such a fuel) from container 114. Nozzle 172 is supportable on a cradle 174 at pump 140, which is provided for stowing the nozzle 172 when not in use. Locking plate 164 includes a notch or cutout 176 at each side thereof, closest to first aperture 150, each cutout 176 providing a space for at least one part or section of hose 170 to pass through cutout 176. Optionally, cutout 176 may be sufficiently large to allow two portions of hose 170 to pass through cutout 176 in a side-by-side manner, such as shown in FIGS. 5, 7, and 9. Aside from permitting passage of hose 170 into cavity 138 of housing 116 when first door 148 is closed, locking plate 162 also substantially limits or prevents tools, an unauthorized user's hands, or other articles from being passed into cavity 138 where forward housing portion 116*a* extends over the forward end 114*a* of container 114. It will be appreciated that cross members 162, 166, flanges 126*a*, 130*a*, and latch receiver plate 164 are substantially symmetrical so that elongate lock member 160 may be installed along either side of security device 112 without interfering with the components along the top surface of container 114.

Figure 10:
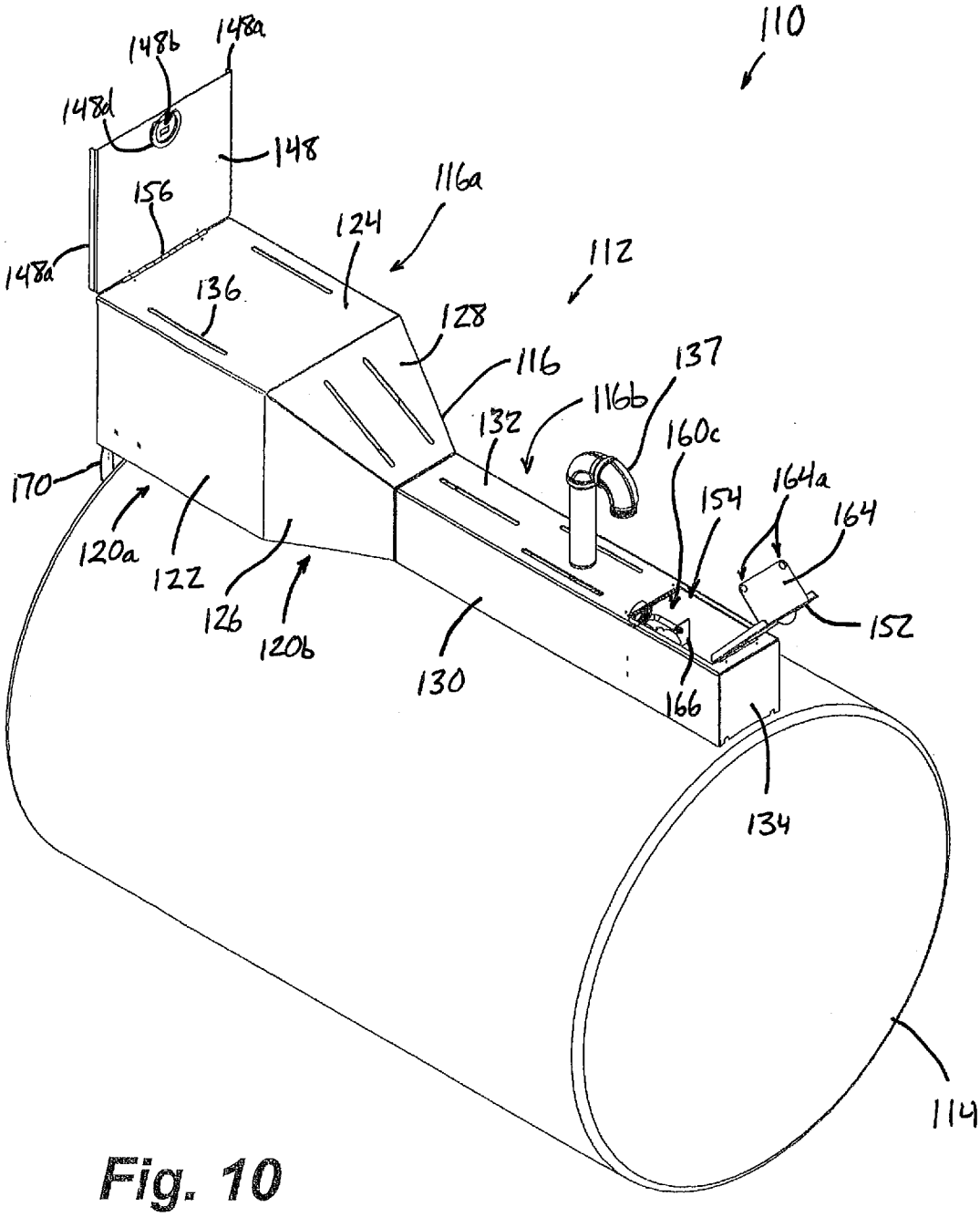
FIG. 10 is a rear perspective view of the secure storage tank system of FIG. 9.
Figure 11:
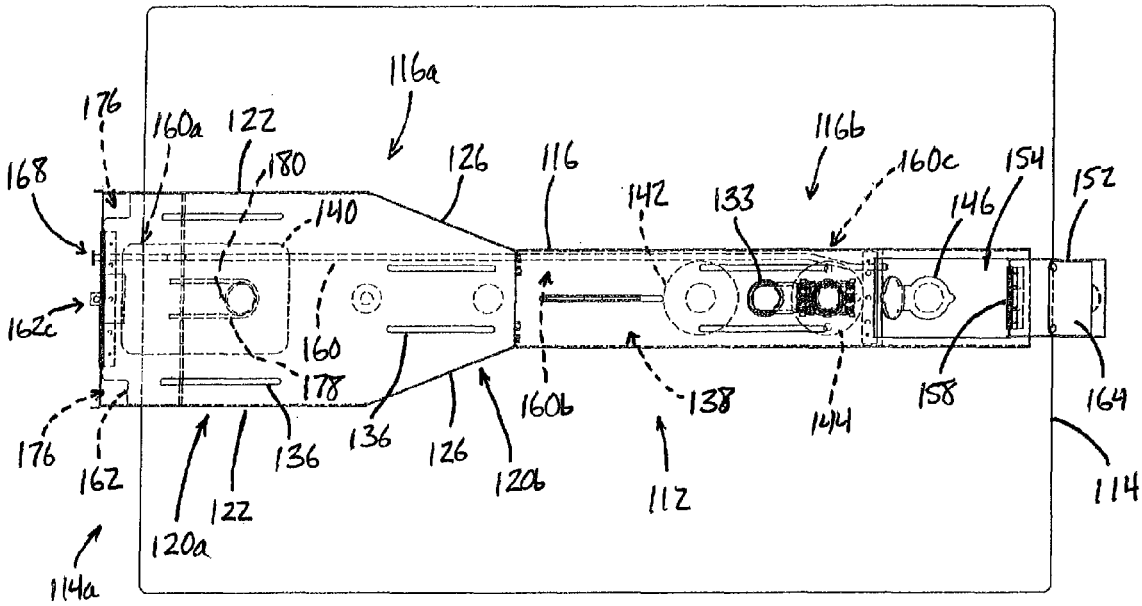
FIG. 11 is a top plan view of the secure storage tank system of FIG. 9.

Security device 112 is fixedly attached to bulk container 114 via an attachment device in the form of a U-shaped bracket or U-bolt 178 that extends around a fluid pipe 180 that extends upwardly from the top of container 114, and that supports and is in fluid communication with pump 140, such as best shown in FIGS. 7, 11, 13, and 14. U-bolt is positioned generally horizontally, and has opposite end portions 178*a* that extend forwardly of fluid pipe 180 and are received in respective lock apertures 162*b* in cross member 162. End portions 178*a* may be threaded to facilitate the attachment of correspondingly-threaded fastener nuts once the end portions 178*a* are positioned so that they extend through lock apertures 162*b*. When first door 148 is closed, first door 148 and cross member 162 cooperate to block unauthorized access to the end portions 178*a* of U-bolt 178, thus preventing unauthorized removal of the U-bolt 178 in addition to preventing access to cavity 138, pump 140, and nozzle 172. Thus, once U-bolt 178 is fastened in position between cross member 162 and fluid pipe 180, and first door 148 is closed, housing 116 cannot be lifted or slid off of container 114 because doing so would require removal of the inaccessible U-bolt 178 and/or pump 140. Cross member 162 further includes a reinforced lock tab 162*c* that projects forwardly through a lock aperture 148*b* in first door 148 when the door 148 is closed, and receives a padlock or the like to secure door 148 in the closed position. In the illustrated embodiment, lock aperture 148*b* is surrounded by a reinforcing shroud or element 148*d* (FIGS. 5 and 10).

Figure 23:
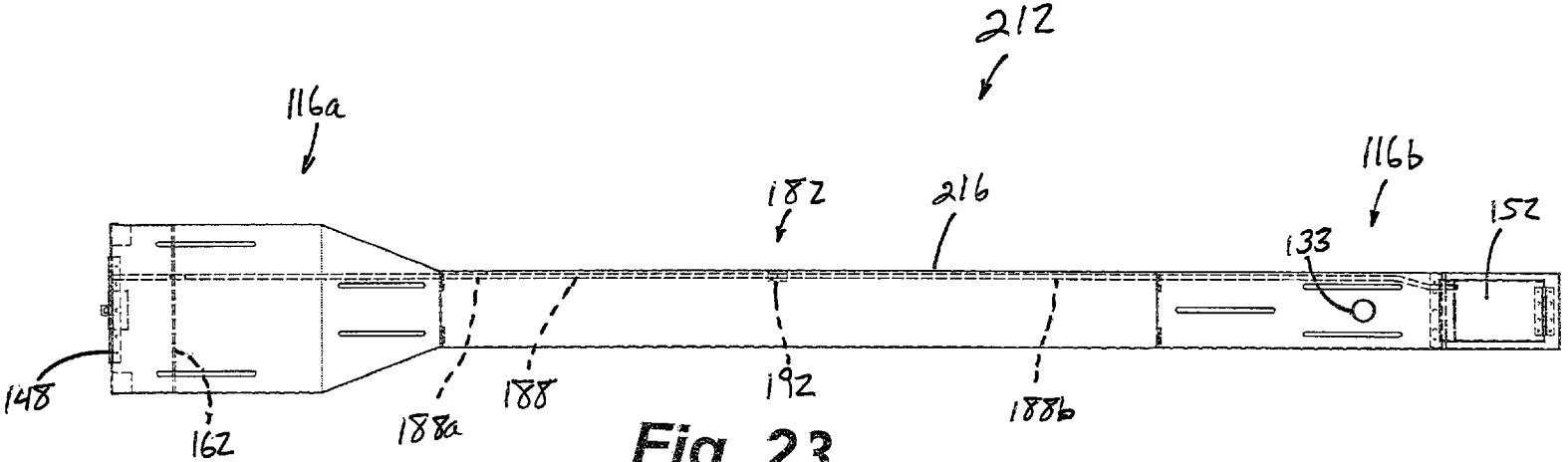
FIG. 23 is a top plan view of an extended-length security device in accordance with the present invention.
Figure 24:
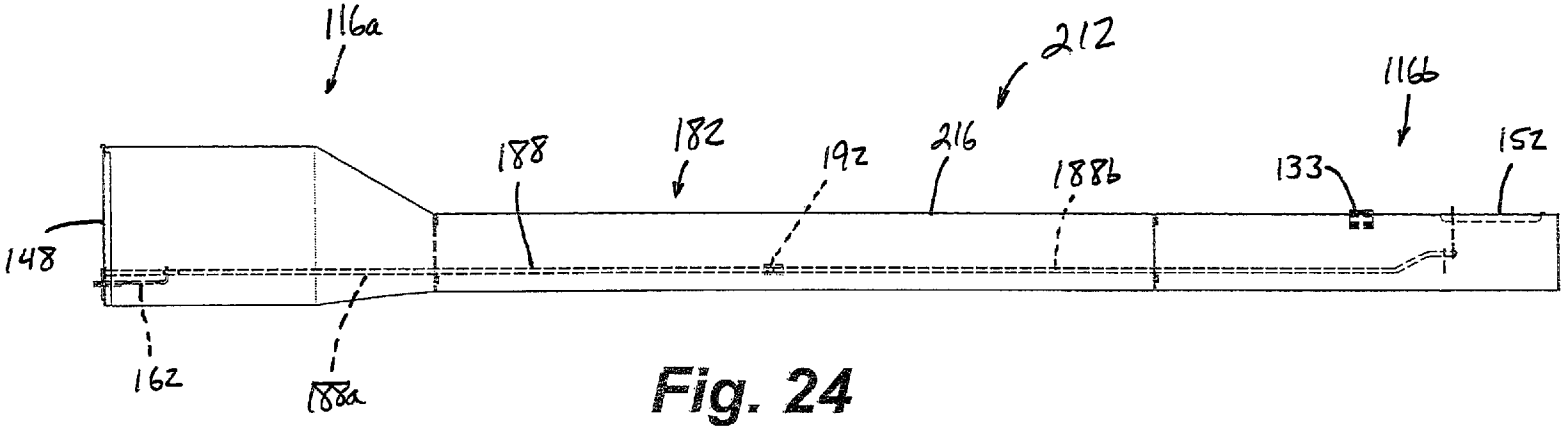
FIG. 24 is a side elevation of the extended-length security device of FIG. 23.
Figure 25:
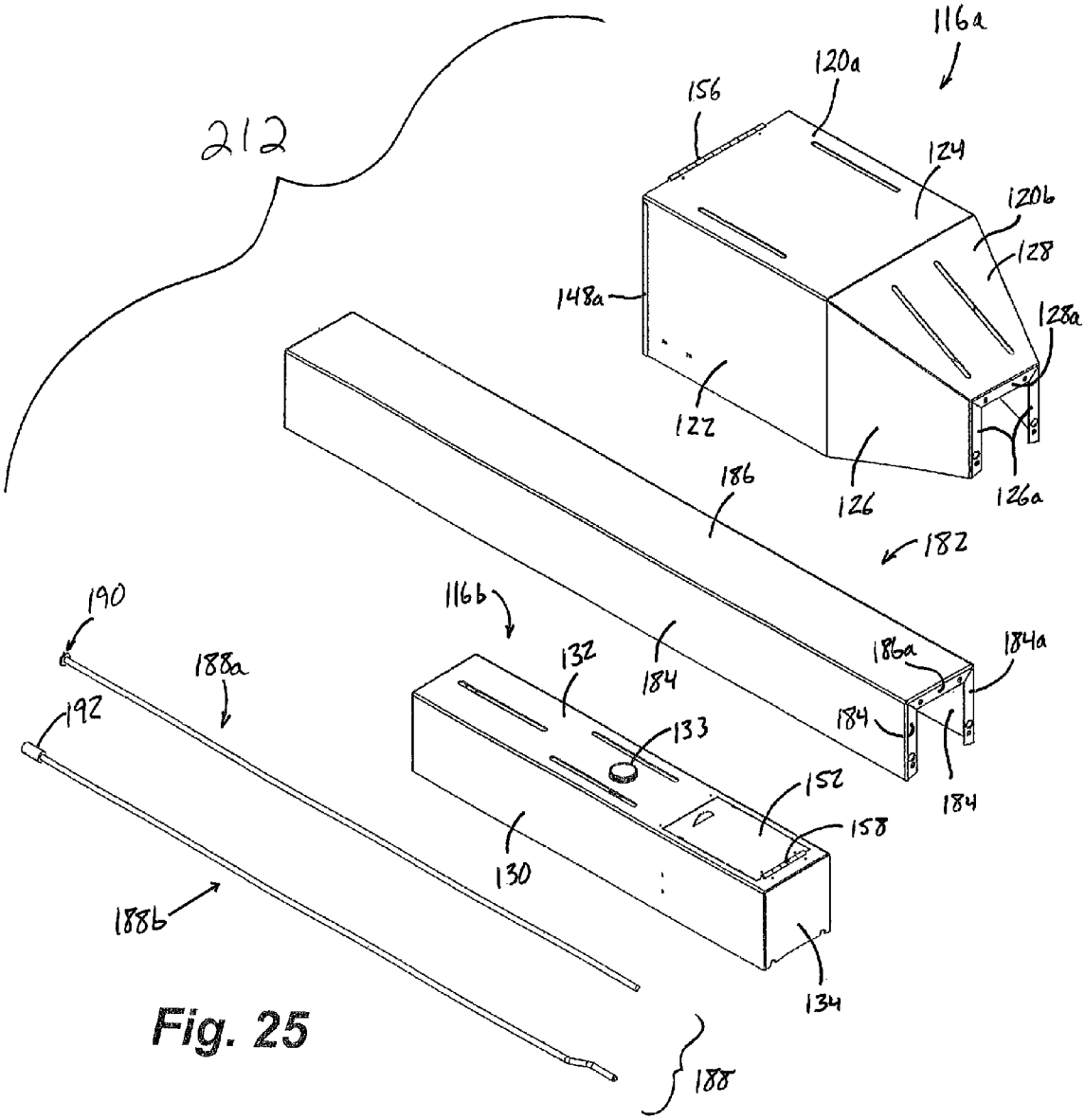
FIG. 25 is a partially-exploded view of the extended-length security device of FIGS. 23 and 24.

Because housing 116 is assembled from separate forward and rearward housing portions 116*a*, 116*b*, which are bolted or otherwise mechanically fastened together at respective flanges (126*a*, 128*a*, 130*a*, and 132*a*), a housing insert or extension 182 may be coupled between housing portions 116*a*, 116*b* to form an extended-length housing 216 of a security device 212, as shown in FIGS. 23-25. Extended-length security device 212 may be suited for use on larger fluid storage containers that are greater in length than container 114. Housing insert 182 includes a pair of opposite side panels 184 and a top panel 186, each panel having respective inwardly-extending flanges 184*a*, 186*a* at its opposite ends, which are configured to abut one another and to be mechanically coupled to the flanges of housing portions 116*a*, 116*b* in substantially the same manner that housing portions 116*a*, 116*b* are coupled directly to one another to form housing 116.

An extended-length elongate lock member 188 is provided for reaching the length necessary to lock and unlock second door 152 when housing insert 182 is placed between forward housing portion 116*a* and rearward housing portion 116*b*. In the illustrated embodiment, elongate lock member 188 is substantially similar to elongate lock member 160, except that lock member 188 is manufactured in two pieces 188*a*, 188*b* (FIG. 25) that are assembled together for use (FIGS. 23 and 24). The forward piece 188*a* of lock member 188 includes a flange or gripping portion 190 at its forward end, and is otherwise a substantially straight rod that is sized to extend approximately half the distance from first door 148 to second door 152. The rearward piece 188*b* is very similar to lock member 160, but includes a coupler or collar 192 at its forward end, which is attached to the rearward end of forward piece 188*a*. Additional support is provided along the length of lock member 188 by apertures 192 in flanges 184*a* of side panels 184. Thus, extended-length elongate lock member 188 functions in substantially the same way as lock member 160, and security device 212 is substantially the same as security device 112 in all other respects, which minimizes complexity and cost of manufacturing security devices (or retrofitting existing security devices) for use on different sizes of tanks or containers. Like security device 10, security devices 112, 212 may be made of cut, formed, and welded steel sections or sheets, for example, or substantially any other sufficiently strong and corrosion-resistant material including other metals or even non-metals such as fiber-reinforced resinous materials.

Thus, it will be appreciated that the security device of the present invention provides for secure covering of the vulnerable components or portions of a bulk storage tank, such as a fuel storage and dispensing tank, so that the tank is less susceptible to tampering or theft of the contents. The tank components may be accessed through one or both of at least two apertures in the housing which are selectively covered by movable access doors. Both of the two or more access doors may be opened after unlocking both doors by an operator positioned at just one of the doors. This is accomplished by using a lock to hold a first door closed and by providing an elongate lock member that is movable internally within the internal cavity of the housing to an unlocking position (for the second door) only when the first door has been unlocked and opened. Thus, the security device provides multiple access points that may be unlocked after manipulation of a single lock, door, and lock member at a single location.

Changes and modifications in the specifically-described embodiments can be carried out without departing from the principles of the present invention, which is intended to be limited only by the scope of the appended claims, as interpreted according to the principles of patent law, including the doctrine of equivalents.

The invention claimed is:

1. A security device for bulk storage tanks, said security device comprising:

a housing configured to be positioned at a bulk storage tank, said housing defining a cavity, at least a portion of which is open toward the bulk storage tank, and said housing further defining first and second apertures for permitting access to said cavity;

a first movable access door positioned at said first aperture of said housing and a second movable access door positioned at said second aperture of said housing, said first and second movable access doors each being operative to selectively cover respective ones of said first and second apertures in said housing;

an elongate lock member movably coupled to said housing in said cavity, said elongate lock member having a proximal end portion disposed toward said first movable access door and a distal end portion disposed toward said second movable access door, said elongate lock member being movable to an unlocking position when said first movable access door is in an open position, and said elongate lock member being substantially fixed in a locking position when said first movable access door is in a closed position;

a latch receiver at said second movable access door, said latch receiver configured to be selectively engaged by said distal end portion of said elongate lock member; and wherein said distal end portion of said elongate lock member engages said latch receiver when said elongate lock member is in its locking position and said second movable access door is in a closed position, and wherein said distal end portion of said elongate lock member is configured to disengage said latch receiver when said elongate lock member is in its unlocking position to permit said second movable access door to be moved to an open position.

2. The security device of claim 1, wherein said first movable access door is pivotably coupled near one end of said housing and said second movable access door is pivotably coupled near an opposite end of said housing.

3. The security device of claim 2, wherein said first movable access door is oriented generally vertically in its closed position and said second movable access door is oriented generally horizontally in its closed position.

4. The security device of claim 1, wherein at least an end portion of said cavity is accessible between said first movable access door in its closed position and the bulk storage tank when said housing is positioned at the bulk storage tank.

5. The security device of claim 1, further comprising an attachment device disposed in said cavity of said housing, said attachment device configured to couple said housing to the bulk storage tank.

6. The security device of claim 5, wherein said attachment device is configured to releasably couple said housing to the bulk storage tank.

7. The security device of claim 5, wherein said attachment device comprises a generally U-shaped bracket and a housing cross member, said U-shaped bracket configured to extend around a pipe extending from the bulk storage tank, said U-shaped bracket having opposite end portions that engage and are retained at said housing cross member.

8. The security device of claim 5, wherein said attachment device is accessible when said housing is positioned at the bulk storage tank only via said first aperture in said housing when said first movable access door is in its open position.

9. The security device of claim 1, further comprising a lock that is operable to secure said first movable access door in its closed position.

10. The security device of claim 9, further comprising:

a lock aperture in said first movable access door;

a lock tab coupled to said housing and extending at least partially through said lock aperture only when said first movable access door is at or near its closed position; and wherein said lock is releasably attachable to said lock tab to selectively secure said first movable access door in its closed position.

11. The security device of claim 1, wherein said housing comprises:

a pair of spaced side panels;

a top panel coupled between said side panels along upper edges thereof; and a rear panel opposite said first aperture and coupled between said side panels and said top panel along rear edges thereof.

12. The security device of claim 11, wherein said second movable access door is pivotably coupled to said top panel near said rear panel.

13. The security device of claim 11, wherein said pair of spaced side panels, said top panel, and said rear panel form a rearward portion of said housing, said housing further comprising a forward portion including a forward pair of spaced side panels and a forward top panel that are joined, respectively, to corresponding ones of said pair of spaced side panels and said top panel of said rearward portion of said housing.

14. The security device of claim 13, further comprising a housing extension insert that is positionable between said forward and rearward portions of said housing, said housing extension insert comprising a pair of spaced extension side panels and a top extension panel coupled between said extension side panels.

15. The security device of claim 11, wherein said top panel comprises a vent aperture configured to engage a vent conduit coupled to the bulk storage tank when said housing is positioned at the bulk storage tank.

16. The security device of claim 11, further comprising at least two spaced support members along one of said top panel and said pair of side panels, and wherein said elongate lock member is slidably supported by said at least two spaced support members.

17. A secure storage tank system comprising:

a bulk storage tank having at least one sidewall and at least one port in said sidewall;

a housing positioned at said at least one sidewall of said bulk storage tank and disposed over said at least one port, said housing defining a cavity, at least a portion of which is open toward the bulk storage tank, and said housing further defining first and second apertures for permitting access to said cavity;

a first movable access door positioned at said first aperture of said housing and a second movable access door positioned at said second aperture of said housing, said first and second movable access doors being operative to selectively cover said first and second apertures in said housing;

an elongate lock member movably coupled to said housing in said cavity and having a proximal end portion disposed toward said first movable access door and a distal end portion disposed toward said second movable access door, said elongate lock member being movable to an unlocking position when said first movable access door is in an open position, and said elongate lock member being substantially fixed in a locking position when said first movable access door is in a closed position;

a latch receiver at said second movable access door; and wherein said distal end portion of said elongate lock member is configured to engage said latch receiver when said elongate lock member is in its locking position and said second movable access door is in a closed position, and wherein said distal end portion of said elongate lock member is configured to disengage said latch receiver when said elongate lock member is in its unlocking position to permit said second movable access door to be moved to an open position.

18. The secure storage tank system of claim 17, further comprising an attachment device at an inner surface of said housing and disposed in said cavity, said attachment device configured to releasably couple said housing to said bulk storage tank.

19. The secure storage tank system of claim 18, wherein said bulk storage tank further comprises a pipe extending outwardly from said sidewall of said bulk storage tank, and wherein said attachment device is configured to releasably couple to said pipe of said bulk storage tank.

20. The secure storage tank system of claim 19, wherein said pipe is positioned near one end of said bulk storage tank, and wherein said bulk storage tank further comprises a dispensing device at said pipe, said dispensing device comprising a nozzle coupled to a flexible conduit in fluid communication with said pipe, and wherein said dispensing device is configured for dispensing liquid from said bulk storage tank via said flexible conduit and said nozzle.

21. The secure storage tank system of claim 20, wherein said dispensing device further comprises a nozzle support for releasably supporting said nozzle, and wherein said first movable access door prevents removal of said nozzle from said nozzle support when said first movable access door is in its closed position.

22. The secure storage tank system of claim 21, wherein at least a portion of said housing overhangs an end of said bulk storage tank so that an end portion of said cavity is accessible between said first movable access door in its closed position and said bulk storage tank, and wherein said flexible conduit of said dispensing device exits said cavity at said housing portion that is accessible between said first movable access door in its closed position and said bulk storage tank.

* * * * *

UNITED STATES PATENT AND TRADEMARK OFFICE

CERTIFICATE OF CORRECTION

PATENT NO. : 8,413,851 B2
APPLICATION NO. : 12/983524
DATED : April 9, 2013
INVENTOR(S) : Mark W. Buinius It is certified that error appears in the above-identified patent and that said Letters Patent is hereby corrected as shown below:

In the Specification

Column 11
Line 23, "160e" should be --160c--

Signed and Sealed this
Third Day of June, 2014

Michelle K. Lee

Michelle K. Lee
*Deputy Director of the United States Patent and Trademark Office*